US011222510B2

(12) United States Patent
Baskerville

(10) Patent No.: US 11,222,510 B2
(45) Date of Patent: Jan. 11, 2022

(54) METHOD AND SYSTEM FOR ROULETTE SIDE BETTING

(71) Applicant: IGT, Las Vegas, NV (US)

(72) Inventor: Paul Baskerville, Las Vegas, NV (US)

(73) Assignee: IGT, Las Vegas, NV (US)

( * ) Notice: Subject to any disclaimer, the term of this patent is extended or adjusted under 35 U.S.C. 154(b) by 268 days.

(21) Appl. No.: 16/417,725

(22) Filed: May 21, 2019

(65) Prior Publication Data

US 2020/0372762 A1 Nov. 26, 2020

(51) Int. Cl.
*G07F 17/32* (2006.01)

(52) U.S. Cl.
CPC ..... *G07F 17/3288* (2013.01); *G07F 17/329* (2013.01); *G07F 17/3262* (2013.01)

(58) Field of Classification Search
CPC . G07F 17/3288; G07F 17/3262; G07F 17/329
See application file for complete search history.

(56) References Cited

U.S. PATENT DOCUMENTS 5,540,442 A * 7/1996 Orselli ..... A63F 5/00 273/142 E
7,281,978 B2 * 10/2007 Moshal ..... A63F 3/00157 273/274
7,549,637 B2 * 6/2009 Lease ..... A63F 5/00 273/142 H
7,637,503 B2 * 12/2009 Sorge ..... A63F 5/00 273/142 E
7,762,883 B2 7/2010 Griswold et al.
7,841,597 B2 11/2010 Cammegh
8,348,277 B2 * 1/2013 Fitoussi ..... A63F 5/007 273/142 E
8,348,749 B1 * 1/2013 Ungaro ..... G07F 17/3258 463/25
8,501,479 B2 * 8/2013 Smith ..... G07F 17/3288 436/17

(Continued)

OTHER PUBLICATIONS

Holmes "Ra Roulette Review—Live European Rouette Meets Slot Machines," roulettesites.org, May 17, 2018, 8 pages [retrieved online from: www.roulettesites.org/games/ra-roulette/].

(Continued)

*Primary Examiner* — Ronald Laneau
*Assistant Examiner* — Matthew D Hoel
(74) *Attorney, Agent, or Firm* — Sheridan Ross P.C.

(57) ABSTRACT

A gaming system uses different gaming devices to provide players with multiple side bets arising from a side bet selected by a player or a side bet having multiple outcomes. In the former case, each potential outcome in a side wagering subset is associated with a different corresponding subset of the first and second sets of potential outcomes, and the first and second sets of potential outcomes are different. In the latter case, the gaming system applies rules that a first winning result in a set of winning results for a game satisfies the first outcome matching the selected potential outcome, a second winning result in the set of winning results for the game satisfies the second outcome matching the selected potential outcome; and a joint winning result in the set of winning results for the game includes each of the first and second outcomes matching the selected potential outcome.

20 Claims, 10 Drawing Sheets

(56) References Cited

U.S. PATENT DOCUMENTS 8,641,515 B2 * 2/2014 Nicely ..... G07F 17/3227 463/25
8,777,716 B2 * 7/2014 Miller ..... G07F 17/3267 463/17
8,827,793 B2 * 9/2014 Kido ..... G07F 17/3258 463/17
9,327,186 B1 * 5/2016 Pececnik ..... A63F 5/0088
9,552,191 B2 1/2017 Oram
9,600,974 B2 * 3/2017 Yee ..... G07F 17/3286
9,613,485 B2 4/2017 Barragan
9,713,762 B2 7/2017 MacDonald et al.
9,779,576 B2 * 10/2017 Shoenhair ..... G07F 17/329
10,147,267 B2 * 12/2018 Yee ..... G07F 17/322
10,198,911 B2 * 2/2019 Kohl ..... G07F 17/3262
10,504,321 B2 * 12/2019 Burgstaller ..... A63F 5/0076
10,546,457 B2 * 1/2020 Snow ..... G07F 17/3267
10,629,024 B1 * 4/2020 Haushalter ..... G07F 17/322
10,706,668 B2 * 7/2020 Burgstaller ..... G07F 17/322
10,713,894 B2 * 7/2020 West ..... G07F 17/34
11,011,014 B1 * 5/2021 Haushalter ..... G07F 17/3225
2005/0020347 A1 * 1/2005 Moshal ..... G07F 17/32 463/17
2005/0181857 A2 * 8/2005 Moshal ..... G07F 17/32 463/17
2005/0239535 A1 * 10/2005 Moshal ..... G07F 17/32 463/17
2005/0288089 A1 12/2005 Cammegh et al.
2006/0249899 A1 * 11/2006 Lease ..... A63F 5/00 273/142 R
2008/0258383 A1 * 10/2008 Sorge ..... A63F 3/00157 273/142 E
2009/0102119 A1 * 4/2009 Kling ..... A63F 5/00 273/142 E
2009/0160132 A1 * 6/2009 Young ..... A63F 3/00157 273/274
2009/0227319 A1 * 9/2009 Kido ..... G07F 17/3258 463/17
2009/0291728 A1 * 11/2009 Ungaro ..... G07F 17/3293 463/13
2010/0164172 A1 7/2010 Au-Yeung
2011/0180990 A1 * 7/2011 Fitoussi ..... A63F 5/007 273/142 E
2011/0204566 A1 * 8/2011 Howard ..... G07F 17/326 273/274
2012/0088565 A1 * 4/2012 Miller ..... G07F 17/3267 463/17
2012/0153571 A1 * 6/2012 Smith ..... G07F 17/3288 273/274
2012/0261881 A1 * 10/2012 Cohen ..... A63F 5/00 273/274
2012/0302307 A1 * 11/2012 Abrahamson ..... G07F 17/3267 463/17
2013/0029741 A1 * 1/2013 Kuhn ..... G07F 17/3286 463/17
2015/0087377 A1 * 3/2015 Yee ..... G07F 17/3286 463/17
2016/0055716 A1 * 2/2016 Young-Czyzewski ..... G07F 17/3211 463/17
2016/0155296 A1 * 6/2016 Baron ..... G07F 17/322 463/25
2016/0263472 A1 * 9/2016 Chavez-Munoz ..... A63F 5/007
2016/0328905 A1 * 11/2016 Kohl ..... G07F 17/3244
2017/0092037 A1 * 3/2017 Snow ..... G07F 17/3244
2017/0109974 A1 * 4/2017 Witty ..... G07F 17/3288
2017/0193747 A1 * 7/2017 Yee ..... G07F 17/3286
2019/0251791 A1 * 8/2019 West ..... G07F 17/3267
2019/0259244 A1 * 8/2019 Witty ..... G07F 17/3244
2020/0111281 A1 * 4/2020 Jones ..... G07F 17/3244
2020/0372762 A1 * 11/2020 Baskerville ..... G07F 17/329
2021/0106905 A1 * 4/2021 Bergant ..... A63F 5/007
2021/0110670 A1 * 4/2021 Berlec ..... G07F 17/3244

OTHER PUBLICATIONS

Walker "Authentic Gaming adds roulette side bets," Totally Gaming, Jun. 21, 2017, 5 pages [retrieved online from: totallygaming.com/news/online/authentic-gaming-adds-roulette-side-bets#:~:text=Live%20casino%20pioneer%20Authentic%20Gaming,to%20operators%20around% 20the%20world.].

* cited by examiner 800 804 808 812 816 820 824 828 832 836 840 844 848 852 856 860

Double 0 5.26% 1

| | | | RNG Outcome | | Wheel Outcome | | Joint Outcome | | Exact # Joint Outcome | | Total | |
|---|---|---|---|---|---|---|---|---|---|---|---|---|
| Number | Outcomes | Probability | Pays (1 to x) | Expected Value | Pays (1 to x) | Expected Value | Pays (1 to x) | Expected Value | Pays (1 to x) | Expected Value | RTP % | House Edge % |
| 0 | 5 | 0.131578947 | 2 | 0.342797784 | 2 | 0.342797784 | 8 | 0.149584488 | 100 | 0.069944598 | 0.905125 | 9.49% |
| 1 | 4 | 0.105263158 | 3 | 0.376731302 | 3 | 0.376731302 | 8 | 0.093490305 | 100 | 0.069944598 | 0.916898 | 8.31% |
| 2 | 4 | 0.105263158 | 3 | 0.376731302 | 3 | 0.376731302 | 8 | 0.093490305 | 100 | 0.069944598 | 0.916898 | 8.31% |
| 3 | 4 | 0.105263158 | 3 | 0.376731302 | 3 | 0.376731302 | 8 | 0.093490305 | 100 | 0.069944598 | 0.916898 | 8.31% |
| 4 | 4 | 0.105263158 | 3 | 0.376731302 | 3 | 0.376731302 | 8 | 0.093490305 | 100 | 0.069944598 | 0.916898 | 8.31% |
| 5 | 4 | 0.105263158 | 3 | 0.376731302 | 3 | 0.376731302 | 8 | 0.093490305 | 100 | 0.069944598 | 0.916898 | 8.31% |
| 6 | 4 | 0.105263158 | 3 | 0.376731302 | 3 | 0.376731302 | 8 | 0.093490305 | 100 | 0.069944598 | 0.916898 | 8.31% |
| 7 | 3 | 0.078947368 | 4 | 0.363573407 | 4 | 0.363573407 | 20 | 0.11634349 | 100 | 0.069944598 | 0.913435 | 8.66% |
| 8 | 3 | 0.078947368 | 4 | 0.363573407 | 4 | 0.363573407 | 20 | 0.11634349 | 100 | 0.069944598 | 0.913435 | 8.66% |
| 9 | 3 | 0.078947368 | 4 | 0.363573407 | 4 | 0.363573407 | 20 | 0.11634349 | 100 | 0.069944598 | 0.913435 | 8.66% |
| | 38 | | | | | | | | | | 91.47% | 8.53% Average |
| | Total | 1 | | | | | | | | | | |

6 Bet: $5.00 $15.00 $15.00 $40.00 $300.00

870 866

*Fig. 8*

METHOD AND SYSTEM FOR ROULETTE SIDE BETTING

BACKGROUND

The present disclosure relates generally to gaming systems and, in particular, to side bet management in a gaming system.

Table games, such as roulette, have maintained popularity for many reasons. Not only is roulette a social game, but the rules are easy to learn and the wheel makes the game particularly exciting. Whether in a casino or online, roulette is one of the most popular games of chance.

In card and non-card games of chance (such as table games), casinos may use proposition bets or side bets. A "proposition bet" (e.g., prop bet, prop, novelty, proxy bet, backbet, or a side bet) is a bet made regarding the occurrence or non-occurrence during a game of an event not directly affecting the game's final outcome.

BRIEF SUMMARY

In certain embodiments, the present disclosure relates to a gaming system for a player in which a side bet can have multiple outcomes in a game of chance. In some embodiments, the electronic gaming system comprises a first gaming device that produces a first outcome in a game, a second gaming device that produces a second outcome in the game, the first and second outcomes being independent of one another, a wagering zone to receive a wager from a player on a potential outcome in a set of potential outcomes of the game; and a side wagering zone to receive a side bet from the player on a selected potential outcome in a side wagering subset of the set of potential outcomes. The gaming system applies the following rules: a first winning result in a set of winning results for the game satisfies the first outcome matching the selected potential outcome; a second winning result in the set of winning results for the game satisfies the second outcome matching the selected potential outcome; and a joint winning result in the set of winning results for the game comprises each of the first and second outcomes matching the selected potential outcome. The first and second gaming devices comprise differing probabilities of producing a winning result in the set of winning results.

In some embodiments, the present disclosure relates to a method for operating a gaming system in which a side bet can have multiple outcomes in a game of chance. In some embodiments, the method comprises: generating, by a first gaming device, a first outcome for a game; generating, by a second gaming device, a second outcome for the game, the first and second outcomes being independent of one another, the first outcome being a potential outcome in a first set of potential outcomes of the first gaming device, the second outcome being a potential outcome in a second set of potential outcomes of the second gaming device, and the first and second sets of potential outcomes being different; comparing the first outcome with a subset of the first and second sets of potential outcomes of the game, the subset being associated with a wager of a player, to determine a first result of the game; comparing the second outcome with the subset to determine a second result of the game; comparing the first and second outcomes with the subset to determine a joint result of the game; and notifying the player of the first, second, and joint results of the game.

In some embodiments, the present disclosure relates to a gaming system for a player in which a side bet can be translated into a number of other side bets. In some embodiments, the electronic gaming system comprises a first gaming device that produces a first outcome in a game, a second gaming device that produces a second outcome in the game, the first and second outcomes being independent of one another, a wagering zone to receive a wager from a player on a potential outcome in a first set of potential outcomes produced by the first gaming device; and a side wagering zone to receive a side bet wager from the player on a side wagering subset of a second set of potential outcomes produced by the second gaming device. Each potential outcome in the side wagering subset is associated with a different corresponding subset of the first and second sets of potential outcomes, and the first and second sets of potential outcomes are different.

Additional features are described herein and will be apparent from the following Description and the figures.

BRIEF DESCRIPTION OF THE SEVERAL VIEWS OF THE DRAWINGS

FIG. 8 is a payout table in accordance with embodiments of the present disclosure;

DETAILED DESCRIPTION

Figure 1:
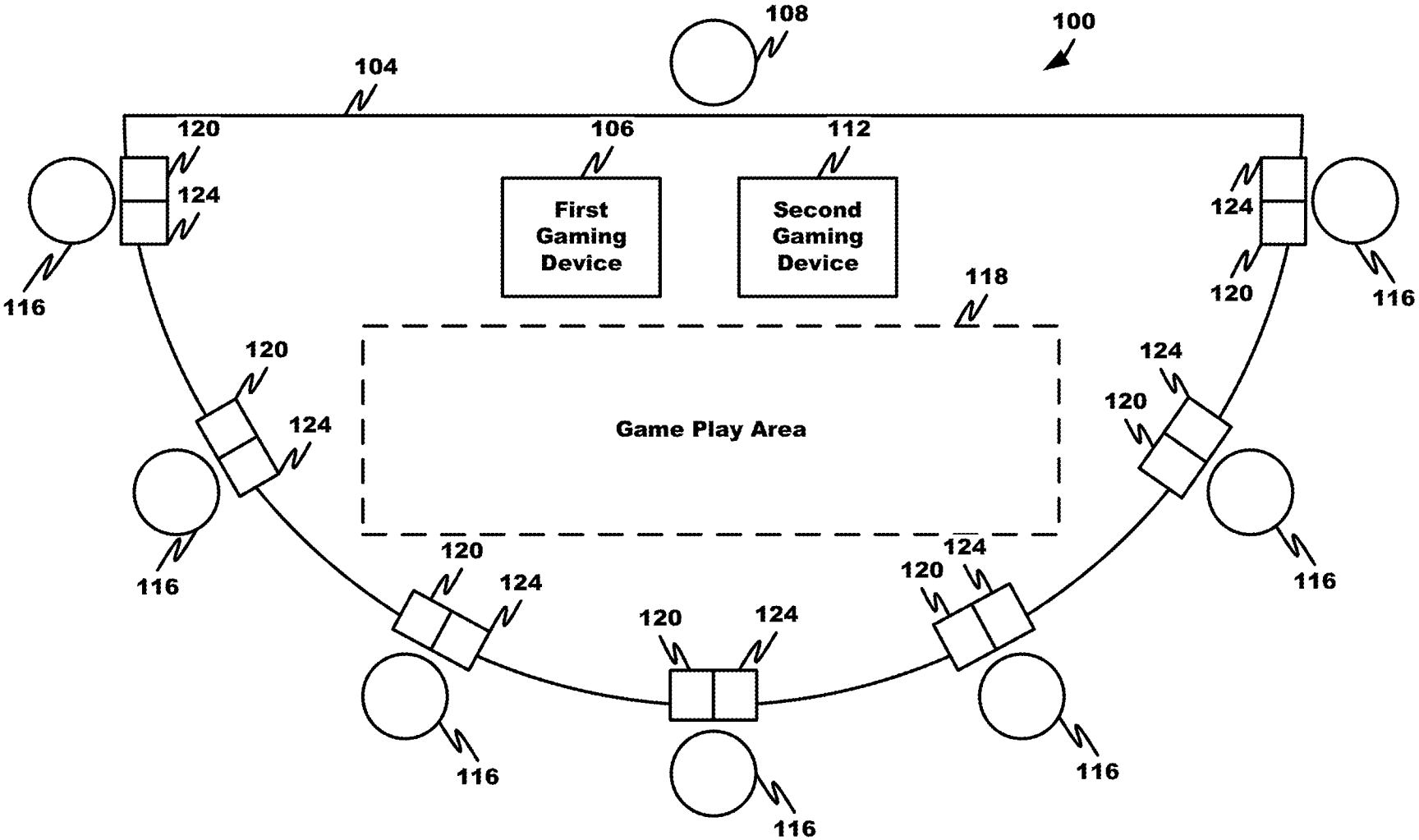
FIG. 1 is a block diagram of a gaming system in accordance with embodiments of the present disclosure.

Embodiments of the present disclosure will be described in connection with a gaming system having one or multiple user devices that enable gaming activity. While certain embodiments of the present disclosure will reference the use of an Electronic Gaming Machine (EGM) or Electronic Table Game (ETG) as a gaming system that enables players to participate in gaming activity, it should be appreciated that embodiments of the present disclosure are not so limited. For example, embodiments of the present disclosure apply to a virtual gaming machine or video gaming gambling machine (VGM).

According to embodiments of the present disclosure, a gaming system can provide an improved gaming experience by providing players with a game including, in one embodiment, multiple gaming devices that generate multiple potential outcomes for wagering and side betting. As used herein, a "potential outcome" refers to a potential event upon which a player can place a bet or side bet. In some embodiments, one of the gaming devices provides potential outcomes that may be used for wagering while the other gaming device provides potential outcomes that may be used for side betting. Additional winning opportunities can be available to players when the outcomes of the gaming devices have a predetermined relationship with one another and/or with a defined subset of potential outcomes.

In one exemplary embodiment for table games, the first gaming device is a random number generator that produces a first set of potential outcomes and the second gaming device is a roulette or other type of wheel that produces a second set of potential outcomes. A player can place a side bet on a first potential outcome in a side wagering subset (such as a set of colors, integers, and/or symbols) of the first and second sets of potential outcomes. The first potential outcome can be associated with a corresponding subset of the first and second sets of potential outcomes that include the color, number, and/or symbol corresponding to the first potential outcome. For example, when the side wagering subset includes integers "0" through "9", inclusive, placing a bet on the "6" causes all numbers in the first and second sets of potential outcomes with the same last integer to be automatically considered to be part of the side bet (e.g., in a standard roulette table the numbers "16", "26" and "36" are automatically considered to be part of the side bet on "6"). The Random Number Generator (RNG) will randomly pick a number 0-36 after no more bets is called. If the randomly picked number is any of "6", "16", "26" or "36", then the first result is a winning result. If the roulette wheel or other wheel lands on a number that is "6", "16", "26" or "36", then the second result is a winning outcome. If each of the first and second outcomes is one of the numbers "6", "16", "26" or "36", the joint result is a winning result. If the first and second outcomes match each other and is a number included as a first potential outcome (e.g., "6", "16", "26", or "36"), then the joint result is a matching result, which has the highest payout for the player. While this embodiment is discussed with reference to a wheel gaming device as the second gaming device and a random number generator as the first gaming device, it is to be understood by one of ordinary skill in the gaming art that each of the gaming devices can be any of a number of other card or non-card gaming devices.

The additional side betting opportunities of the gaming system can not only increase player excitement, particularly when the players are notified of the first and second outcomes and/or first, second, and joint results at different times, but also enable more players to engage in a single instance of a game of chance. In addition to creating a sense of camaraderie between the primary player and the side betting player, the side bet-betting player often feels like they have an additional opportunity for winning a particular game of chance. The additional side betting opportunities can also increase a number and frequency of player awards while increasing gaming revenue for casinos (without requiring additional casino funding or change of casino payout tables for the games in the gaming session).

There are additional benefits for wheel games, such as roulette. While roulette remains one of the most popular games of chance, it has been relatively unchanged for years. Improvements to roulette have been attempted but have been difficult to achieve because they often involve making the game more complicated. The additional side betting opportunities of this disclosure can provide a roulette game with opportunities for side bets that simultaneously increase the excitement associated with the roulette game without unwantedly complicating the primary game of roulette.

Embodiments can include EGMs or ETGs which allow players at the gaming systems not only to participate in side wagering activities but also to play concurrently in an active game at the gaming system. The player desiring to place a side bet, or the side wagering player, can place the wager on an outcome of his or her game or on an event or activity that is dependent, at least in part, on the decisions or actions of a third party. The third party can be, for example, another person or a machine. The side wagering player may not be an active player of or have control over the gaming activity that is the subject of the side bet.

As used in this disclosure, the term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

With reference now to FIG. 1, a multi-player gaming table system 100 is depicted that is enabled for side betting and includes gaming table 104, dealer or croupier 108, and players 116. The table system 100 includes first and second gaming devices 106 and 112 and optional game play area 118 to accommodate game play activities of players (such as throwing dice and placing cards). Each player 116 has a corresponding wagering zone 120 to receive wagers of the players on a first potential set of outcomes produced by the first gaming device 106 and side wagering zone 124 to receive side bets on the second potential set of outcomes produced by the second gaming device 112.

The first and second gaming devices 106 and 112 depend on the type of game being played. For card games (such as baccarat, blackjack,), one or more of the first and second gaming devices 106 and 112 can be, for example, physical or virtual cards or other symbols. For dice games (such as craps and sic bo), one or more of the first and second gaming devices 106 and 112 can be, for example, one or more physical or virtual dice. For wheel games (such as roulette, boule, or big six wheel), one or more of the first and second gaming devices 106 and 112 can be, for example, a physical or virtual rotatable horizontal or vertical wheel. For slot games, one or more of the first and/or second gaming devices 106 and 112 can be, for example, a slot machine. In any of the foregoing examples, the first or second gaming device 106 or 112 can be a hardware random number generator (HRNG) or a pseudo-random number generator (PRNG).

In any of these gaming device combinations, the first gaming device generates or produces a first outcome for a game, and the second gaming device generates or produces a second outcome for the game. The first and second outcomes are generally independent of one another. The first outcome is a potential outcome in a first set of potential outcomes of the first gaming device, and the second outcome is a potential outcome in a second set of potential outcomes of the second gaming device. The first and second sets of potential outcomes are commonly different but may be overlapping. For example, a subset of the first and second sets of potential outcomes used for side betting may be in common to both the first and second sets of potential outcomes. The first and second gaming devices can additionally or alternatively have differing probabilities of producing a winning result in a corresponding first and second set of winning results corresponding, respectively, to each of the first and second gaming devices.

The multi-player gaming table system 100 compares the first outcome with a subset of the first and second sets of potential outcomes of the game, the subset being associated with a wager of a player, to determine a first result of the game; compares the second outcome with the subset to determine a second result of the game; compares the first and second outcomes with the subset to determine a joint result of the game; and notifies the player of the first, second, and joint results of the game. To make the comparisons possible, it is common for the first and second outcomes to be expressed in a similar format, whether a number (e.g., integer), color, symbol, or combination thereof. For example, in a roulette or dice game, the first and second outcomes are commonly expressed as a number, color, or combination thereof. In a slot or card game, the first and second outcomes are commonly expressed as a symbol, color, or combination thereof.

In response to the player 116 placing a side bet on a first potential outcome in the subset, the multi-player gaming table system 100 can automatically translate the first potential outcome into the subset. Stated differently, the subset comprises the first potential outcome upon which the player 116 placed a side bet and a second potential outcome that is different from the first potential outcome and upon which the player 116 did not directly place a side bet. Each potential outcome in the subset is a potential outcome for each of the first and second gaming devices.

In one embodiment, a first winning result comprises the first outcome matching a potential outcome in the subset and, in determining the payout to the winning player, comprises a first product of the wager and a first multiplier. A second winning result comprises the second outcome matching a potential outcome in the subset and, in determining the payout to the winning player, comprises a second product of the wager and a second multiplier. Because the probabilities for each of the first and second gaming devices of generating the first or second winning results, respectively, is the same, the first and second multipliers are the same.

In the embodiment, a joint (non-matching) winning result comprises each of the first and second outcomes matching a potential outcome in the subset (but not each other), and, in determining the payout to the winning player, the joint winning result comprises a third product of the wager and a third multiplier. The third multiplier is greater than each of the first and second multipliers due to the lower probability of the occurrence of a joint winning result.

In the embodiment, a joint (matching) winning result of the game comprises each of the first and second outcomes matching each other and a potential outcome in the subset, and, in determining the payout to the winning player, the joint (matching) winning result comprises a fourth product of the wager and a fourth multiplier. The fourth multiplier is greater than each of the first, second, and third multipliers due to the lower probability of the occurrence of the joint matching winning result.

With reference to FIG. 2, a multi-player ETG system 200 for side wagering according to another embodiment is depicted. The ETG system 200 includes an ETG 228 having a master table controller (MTC) 204, a player surface 208, a main table display 210, and a plurality of player station gaming systems 212 which, for example, may be connected to the MTC 204 via at least one switch hub 218. In at least one embodiment, the MTC 204 may include at least one processor or CPU 216, and memory 220. Additionally, the ETG system 200 includes a roulette wheel 224 as the second gaming device, a random number generator 230 in the memory 220 as the first gaming device, and one or more network interfaces 224 for communicating with other devices and/or systems in a casino network.

The processor 216 may correspond to one or many computer processing devices. For instance, the processor 216 may be provided as silicon, as a Field Programmable Gate Array (FPGA), an Application-Specific Integrated Circuit (ASIC), any other type of Integrated Circuit (IC) chip, a collection of IC chips, a microcontroller, a collection of microcontrollers, or the like. As a more specific example, the processor 216 may be provided as a microprocessor, Central Processing Unit (CPU), or plurality of microprocessors that are configured to execute the instructions sets stored in memory 220.

The memory 220 may include any type of computer memory device or collection of computer memory devices. The memory 220 may be volatile or non-volatile in nature and, in some embodiments, may include a plurality of different memory devices. Non-limiting examples of memory 220 include Random Access Memory (RAM), Read Only Memory (ROM), flash memory, Electronically-Erasable Programmable ROM (EEPROM), Dynamic RAM (DRAM), etc. The memory 220 may be configured to store the instruction sets depicted in addition to temporarily storing data for the processor 216 to execute various types of routines or functions.

The random number generator 230 can be any HRNG or PRNG, depending on the application. A pseudo-random number generator algorithm takes a seed value as input and provides a "random" number as output. The random generator 230 may be run discontinuously or continuously depending on the application. When run continuously, such as in a PRNG, each randomly generated number can serve as a seed for the next iteration of the algorithm. The random number generator 230, when embodied as an HRNG, can be burned onto a chip certified by a third party. The certified chips are generally unalterable without physically breaking into the gaming machines. As will be appreciated, any HRNG or PRNG may be used provided that the randomly generated number output is not predictable and cannot be compromised or altered by a malicious actor.

The main table display 210 may present information for the exclusive use of the dealer 108 and other information to be viewed by the dealer, players, spectators, and other persons. For example, the main table display can include a table control console for use by the dealer 108 and/or other casino employees to facilitate and execute game play operations and table configuration operations. Various types of information which may be displayed at the common main table display 120 include player wagering and side betting options, payout information for each option, wagers and side bets of players 116, historical statistics and trends, and other gaming information. In one embodiment, the common main table display 210 may be used to display game play instructions; display table configuration information; display wagering information; indicate which of the players is currently playing (e.g., show active player); display active players' actions; identify players waiting for an opening at the table (e.g., next up); display bonus game; display progressive jackpots; display information relating to side wagers placed by players at the gaming table; display information relating available side wager opportunities; and display winning and/or losing outcomes for each player.

Figures 2A, 2B:
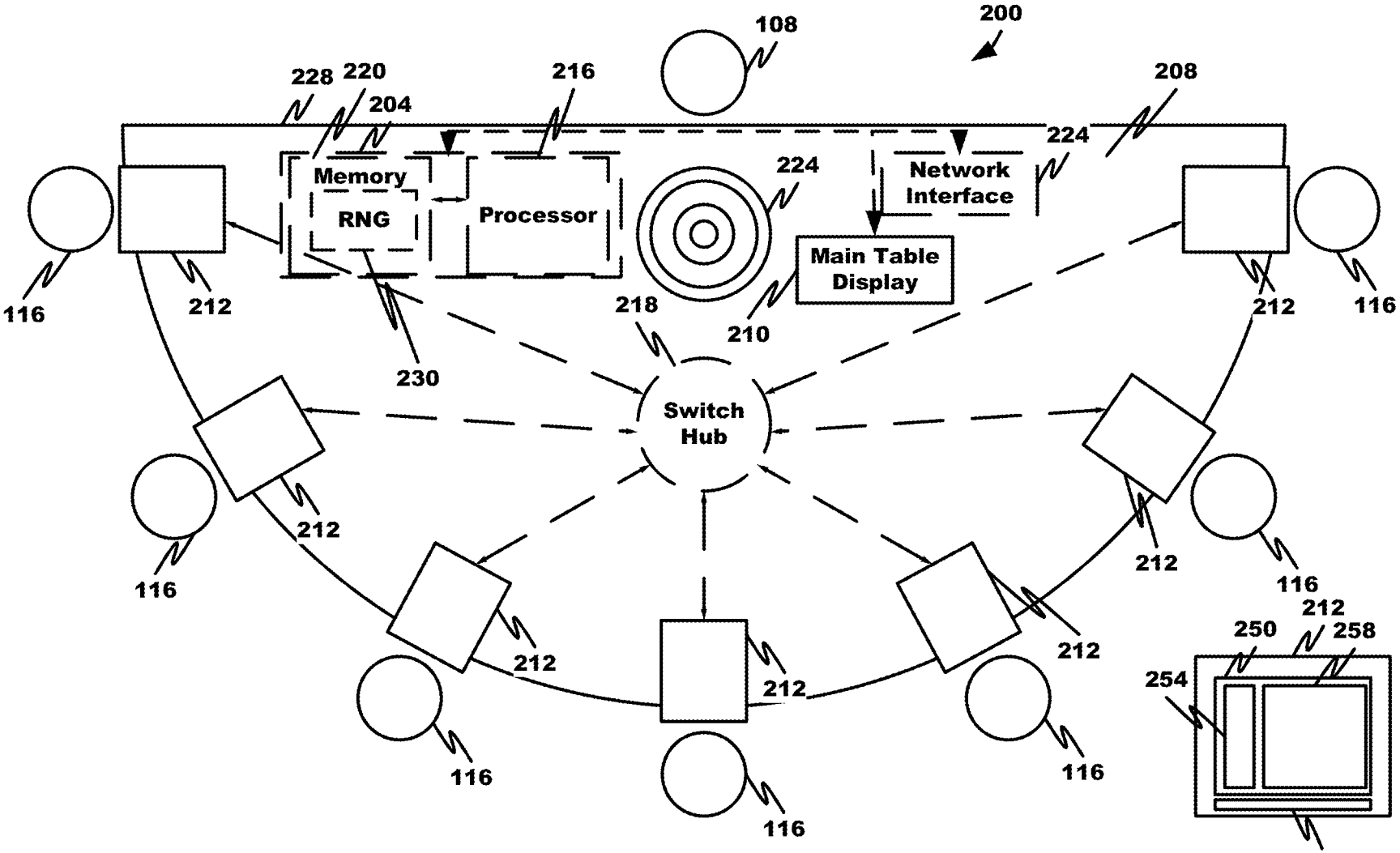
FIG. 2A is a block diagram of a gaming system in accordance with embodiments of the present disclosure.
FIG. 2B is a block diagram of a gaming system in accordance with embodiments of the present disclosure.

With reference to FIG. 2B, each player station gaming system 212 includes a corresponding electronic display 250 and may also include a corresponding player input interface 262. The electronic display 250 can display changeable display content such as various representations of a roulette wheel and other information used to convey game play information, game status information, wager information, and the like. The display can include a corresponding player wagering zone 258 or side wagering zone 254 for electronic placement of wagers and side bets. The player input interface 262 can be incorporated into the electronic display 250 as a touchscreen to accept player input. Alternatively, or in addition, the player input interface 262 can include one or more buttons may also be provided for player inputs. Alternatively, or in addition, the player input interface 262 can include gesture recognition devices, such as one or more cameras (not shown) and gesture recognition image processing software. The electronic display 250 and player input interface 262 can allow players to perform various other activities, such as for example, performing searches for available side wagering opportunities; configuring the corresponding player station gaming system 212 with a set of side bets; placing one or more side bet wagers; and monitoring game play activities, of the current gaming session and gaming sessions of other players on other gaming systems. Other components of the player station gaming system 212 can include a ticket printer (not shown) and bill acceptor (not shown).

In one embodiment, the plurality of electronic displays 250 are interactive with users and may be implemented as separate physical touch-screen displays which have been mounted into (or onto) the body of a conventional-type casino gaming table. In an alternate embodiment, the entire top surface (or selected portions thereof) 208 of the intelligent gaming table may be implemented as a continuous display using multi-touch technology for supporting, across the player station gaming systems 212, multiple simultaneous touch points enabling concurrent real-time multi-player interaction, and the electronic displays implemented as specific display regions within the continuous display.

According to one embodiment, the ETG system 200 may be operable to read, receive signals, and/or obtain information from various types of media (e.g., player tracking cards) and/or other devices such as those issued by the casino. For example, media detector/reader may detect wireless signals from one or more wireless devices (such as, for example, an RFID-enabled player tracking card) in the possession of players at the gaming table. The media detector/reader may also be operable to utilize the detected wireless signals to determine the identity of individual players associated with each of the different player tracking cards.

As will be appreciated, many other input and output components may also be provided at the ETG system 200, as will be readily appreciated. Further, other configurations, arrangements, shapes and sizes for the ETG system 200 may also be used.

While the ETG system 200 is described with reference to wheel games, the ETG system 200 can be modified to enable players to play automated and live card and noncard games of chance, including dice games, such as craps and sic bo.

Figure 3:
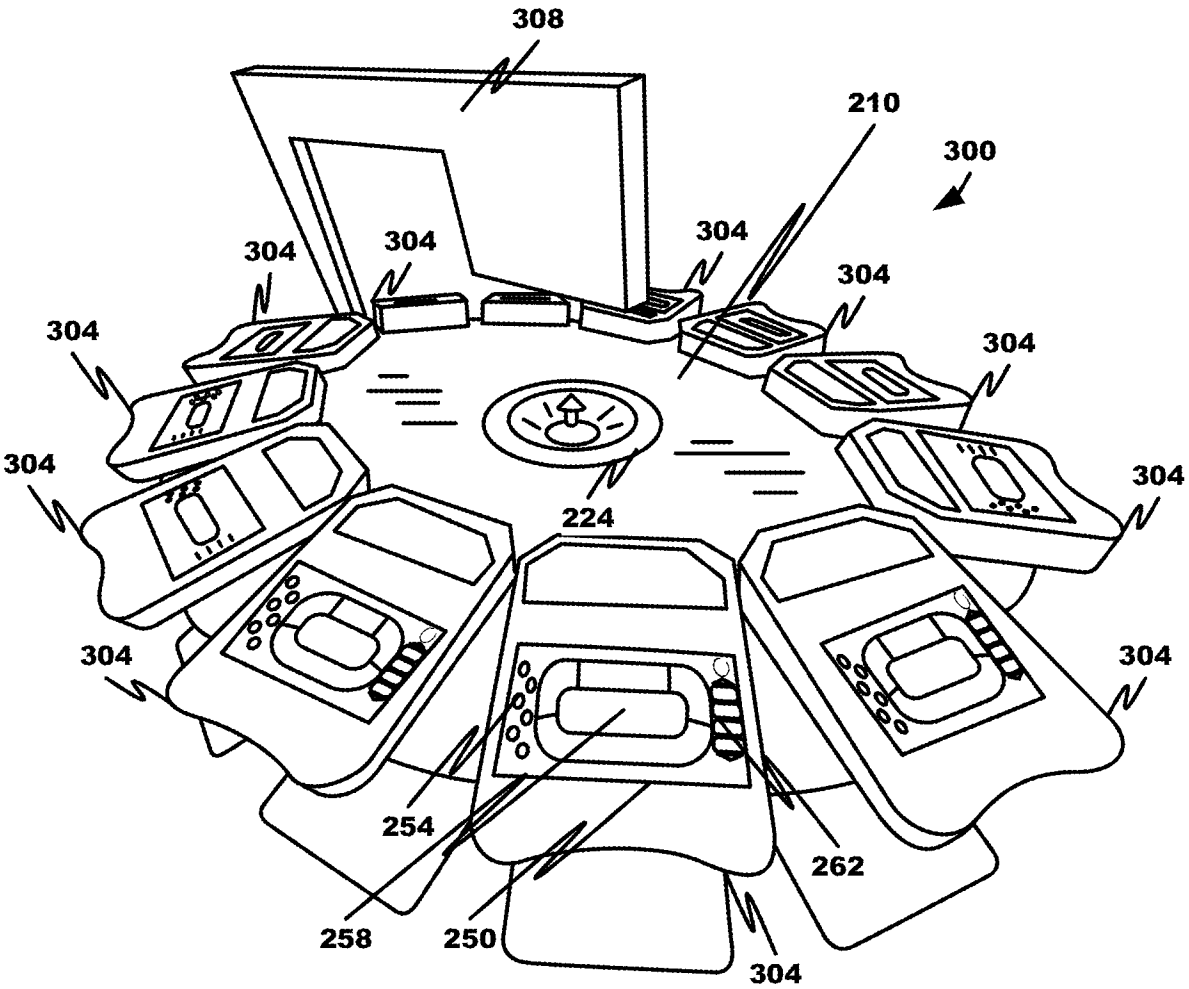
FIG. 3 is a perspective view of a gaming system in accordance with embodiments of the present disclosure.
Figure 4:
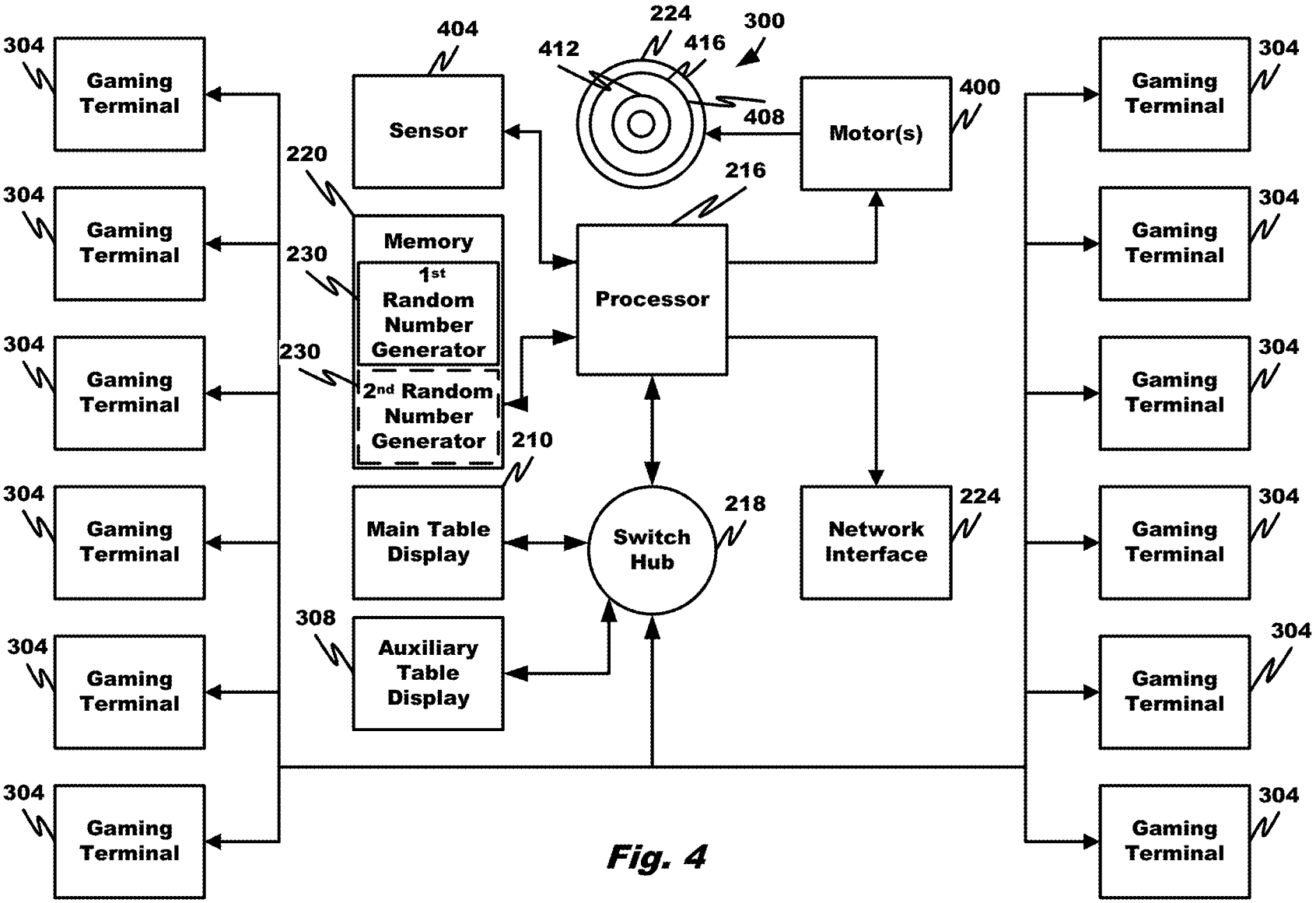
FIG. 4 is a block diagram depicting additional aspects of a gaming system in accordance with embodiments of the present disclosure.

With reference to FIGS. 3 and 4, an ETG system 300 comprising a physical or virtual roulette wheel 224 and multiple networked electronic gaming terminals 304 is depicted according to another embodiment. The electronic gaming terminals 304 may correspond to a non-limiting example of a player station gaming system 212 of FIG. 2. The ETG system 300 can be linked to various different types of table games and to multiple different electronic gaming tables, including simultaneously.

Although a wide variety of possible layouts and arrangements can be applied to any given ETG system 300 and electronic gaming terminal 304, a particular configuration is provided by way of illustration. As is generally shown in FIGS. 3 and 4, the ETG system 300 can include multiple electronic gaming terminals 304, a physical or virtual roulette wheel 224, a main table display 210, an auxiliary table display 308, a processor 216 and memory 220, a switch hub 218, one or more network interfaces 224, motor(s) 400, and a sensor 404. The main table display 210, processor 216 and memory 220, switch hub 218, and one or more network interfaces 224 have been discussed above with reference to ETG system 200. Many other input and output components may also be provided at ETG system 300, as will be readily appreciated. Further, other configurations, arrangements, shapes and sizes for the ETG system 300 may also be used.

The electronic gaming terminals 304 include many of the features of the player gaming station systems 212, including the player input interface 262 (which includes the player wagering zone 258 or side wagering zone 254), and player input interface 262. The electronic gaming terminals 304 can, in some applications, be implemented as an EGM, virtual gaming machine, or VGM. Other components of the electronic gaming terminals 304 are discussed below with reference to FIG. 6.

In one embodiment, the roulette wheel 224 is implemented as an automatic roulette wheel. A typical roulette wheel includes a numbered ring bearing a circular array of numbered segments bearing numbers 1 through 36. In addition, the numbered ring typically includes the number "0" and one or more of "00", "000", and "0000" disposed at diametrically opposite locations on the numbered ring. The numbers 1 through 36 are not disposed in numerical order, but are typically disposed in a predetermined arrangement, such that roulette wheels located in different casinos will have the same standard predetermined numbered ring arrangement. The numbers disposed in a circular array in the numbered ring region of the wheel bear the alternating colors of red and black, with the exception of the "0", "00", "000", and "0000" numbers, which are typically colored green. A ring of pockets corresponding in number to the plurality of numbers of the circular numbered ring lies adjacent, but radially inward of, the numbered ring. In addition, a typical roulette wheel includes a circular, inclined ball track, disposed above, and radially outwardly of the numbered ring. In operation, a typical roulette wheel is rotated by a croupier or dealer 108 about a substantially vertical axis, a ball is dropped onto the ball track of the rotating roulette wheel and, as the wheel slows, the ball moves radially inward and comes to rest in one of the pockets associated with a particular one of the numbers of the numbered ring to determine the outcome of the roulette game. As will be appreciated, in automatic roulette a processor 216, rather than a croupier or dealer 108, receives placements of wagers, causes one or more motor(s) 400 to rotate the roulette wheel, causes the ball to drop in the rotating wheel, senses by a sensor 404 a pocket into which the ball has come to rest, and determines and causes payment of winnings using a machine rather than a croupier or dealer. The ball can be propelled along the ball track by centrifugal forces caused by rotation of the wheel. Alternatively, a device (not shown) can provide an impulse, such as by one or more air jets, to the ball as it is positioned on the ball track.

The processor 216 may be communicatively coupled to motor(s) 400, which in turn are coupled to the roulette wheel 224 to rotate the wheel. The motor(s) 400 may be any known motor, e.g., a stepper motor, able to increase and decrease the speed of the roulette wheel.

The sensor 404 may be positioned on the roulette wheel in a location that will detect the location of the roulette ball (not shown), such as between a separator ring (not shown)

and outer ring (not shown) of the wheel. Alternatively, the sensor 404 may not be positioned directly on the roulette wheel 224, but instead may be positioned close enough to the roulette wheel 224 to detect the location of the roulette ball. The sensor 404 may include any known sensor such as a mechanical sensor, an electrical sensor, a camera, a magnetic sensor, an optical sensor such as an infrared (IR) sensor, and the like.

In another embodiment, the roulette wheel can be a random number generator-based roulette wheel that may be a virtual wheel (e.g., a software-simulated wheel displayed by the main table display 210). An indicator 416, which can be displayed in association with a top ring 408 as an arrow, pointer, or any other indicator, can virtually rotate at a predetermined speed. The random number generator, such as the second random number generator 230, may generate a plurality of random numbers. The indicator 416 may virtually rotate in a first direction several times around the outside of a virtual outer ring 408. The indicator 416 may rotate in a direction or same different from the rotational direction of the outer ring 408. While the indicator may be used in addition to the roulette ball to play the game of chance, the indicator may also be used in place of or as a substitute to the roulette ball. The rotation speed of the indicator 416 may be virtually decreased. The rotation of an inner ring 412 may be stopped such that the selected winning slot (not shown) corresponds to a second random number on the outer ring 408. The rotation of the indicator 416 may be virtually stopped such that the indicator 416 points to the selected winning slot corresponding to a first random number on the outer ring 408.

While the mechanical or virtual roulette wheel 224 produces the second outcome, the first random number generator 230 can generate or produce the first outcome. As noted, the first and second outcomes are used by the processor 216 to determine whether or not the game has produced a winning result for one or more players.

In any of the above embodiments, the main table display 210 and auxiliary table display 308 can provide any of the gaming information referenced above in connection with the ETG system 200 as well as gaming information from other networked gaming systems. For example, the main table display 210, auxiliary table display 308, and the electronic display 250 of the electronic gaming terminals 304 can display the first and second outcomes and any winning game result(s).

While the embodiments of FIGS. 2A, 2B, 3 and 4 are discussed with reference to a wheel gaming device (e.g., a roulette wheel 224) as the second gaming device and a random number generator 230 as the first gaming device, it is to be understood by one of ordinary skill in the gaming art that each of the gaming devices can be any of a number of other card or non-card gaming devices.

Figure 5:
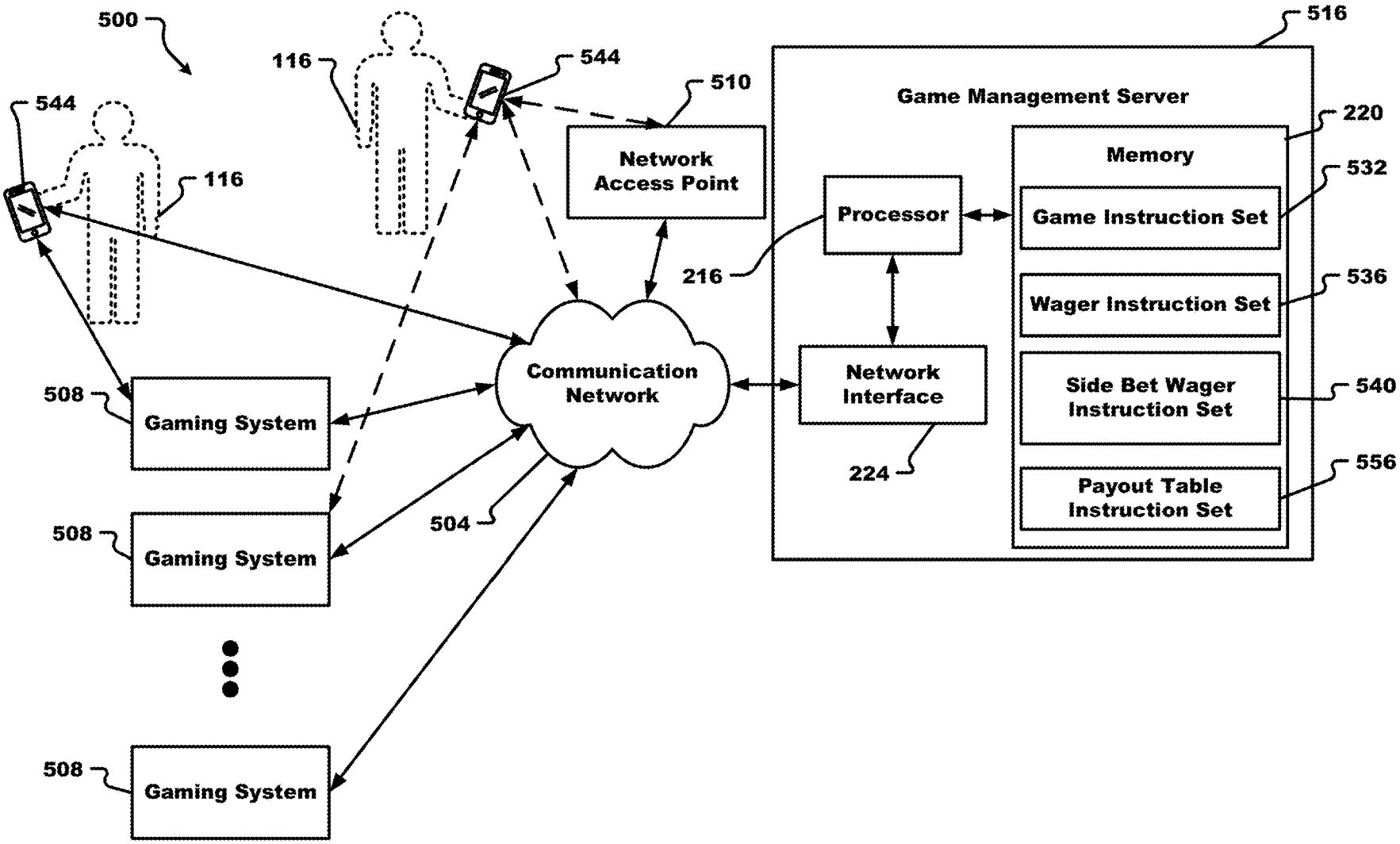
FIG. 5 is a block diagram depicting additional aspects of a gaming system in accordance with embodiments of the present disclosure.

With reference now to FIG. 5, details of an illustrative networked gaming system 500 will be described in accordance with at least one embodiment of the present disclosure. The components of the networked gaming system 500, while depicted as having particular instruction sets and devices, are not necessarily limited to the examples depicted herein. Rather, a networked gaming system 500 according to embodiments of the present disclosure may include one, some, or all of the components depicted in the networked gaming system 500 and does not necessarily need to include all of the components in a single device. For instance, the components of a server may be distributed amongst a plurality of servers and/or other devices (e.g., a gaming system, portable user device, etc.) in the networked gaming system 500 without departing from the scope of the present disclosure.

The networked gaming system 500 is shown to include a communication network 504 that interconnects and facilitates machine-to-machine communications between one or multiple electronic gaming systems 508, and a game management server 516. An electronic gaming system 508 may include any type of known gaming system such as a slot machine, a table game, an electronic table game (e.g., a card game such as video poker or a noncard game such as roulette or a dice game), a skill-based game, etc. While the electronic gaming system 508 can be the ETG system 200, ETG system 300, and/or electronic gaming terminals 304, the gaming system 508 can be in any other form of EGM, virtual gaming machine, VGM, table game, ETG, or other computing device, personal gaming system, or collection of computing devices.

It should be appreciated that the communication (gaming) network 504 may correspond to one or many communication networks without departing from the scope of the present disclosure. In some embodiments, the various gaming systems 508 and game management server(s) 516 may be configured to communicate using various nodes or components of the communication network 504. The communication network 504 may comprise any type of known communication medium or collection of communication media and may use any type of protocols to transport messages between endpoints. The communication network 504 may include wired and/or wireless communication technologies. The Internet is an example of the communication network 504 that constitutes an Internet Protocol (IP) network consisting of many computers, computing networks, and other communication devices located all over the world, which are connected through many telephone systems and other means. Other examples of the communication network 504 include, without limitation, a standard Plain Old Telephone System (POTS), an Integrated Services Digital Network (ISDN), the Public Switched Telephone Network (PSTN), a Local Area Network (LAN), a Wide Area Network (WAN), a cellular network, and any other type of packet-switched or circuit-switched network known in the art. In addition, it can be appreciated that the communication network 504 need not be limited to any one network type, and instead may be comprised of a number of different networks and/or network types. Moreover, the communication network 504 may comprise a number of different communication media such as coaxial cable, copper cable/wire, fiber-optic cable, antennas for transmitting/receiving wireless messages, and combinations thereof.

In some embodiments, the electronic gaming systems 508 may be distributed throughout a single property or premises (e.g., a single casino floor) or the electronic gaming systems 508 may be distributed among a plurality of different properties. In a situation where the electronic gaming systems 508 are distributed in a single property or premises, the communication network 504 may include at least some wired connections between network nodes. As a non-limiting example, the nodes of the communication network 504 may communicate with one another using any type of known or yet-to-be developed communication technology. Examples of such technologies include, without limitation, Ethernet, SCSI, PCIe, RS-232, RS-485, USB, ZigBee, WiFi, CDMA, GSM, HTTP, TCP/IP, UDP, etc.

The electronic gaming systems 508 may utilize the same or different types of communication protocols to connect with the communication network 504. It should also be appreciated that the gaming systems 508 may or may not present the same type of game to players 116. For instance, a first electronic gaming system 508 and a second electronic gaming system 508 may correspond to gaming systems that present the same or different games. It may be possible for the some of the electronic gaming systems 508 to communicate with one another via the communication network 504. In some embodiments, one or more of the electronic gaming systems 508 may only be configured to communicate with a centralized management server (not shown) and/or the game management server 516. Although not depicted, the networked gaming system 500 may include a separate server or collection of servers that are responsible for managing the operation of the various electronic gaming systems 508 in the networked gaming system 500. It should also be appreciated that the game management server 516 may or may not be co-located with one or more electronic gaming systems 508 in the same property or premises. Thus, one or more electronic gaming systems 508 may communicate with the game management server 516 over a WAN, such as the Internet. In such an event, a tunneling protocol or Virtual Private Network (VPN) may be established over some of the communication network 504 to ensure that communications between an electronic gaming system 508 and a remotely-located server, such as the game management server 516, are secured. Additionally or alternatively, one or multiple electronic gaming systems 508 may function as the game management server 516.

One, some, or all of the electronic gaming systems 508 may correspond to a type of device that can enable a first player 116 to interact, via a gaming system 408, with a second player 116 and/or with a remotely located server, such as the game management server 516, in connection with playing games of chance and/or skill.

By way of example, the electronic gaming system 300, when networked as shown in FIG. 5, can provide to the player remote wagering games which may advantageously be played in addition to or instead of the live table games, even though the remote wagering games may have different wagers, different rules, or both.

In addition to playing games on a gaming system 508, the players 116 may also be allowed to interact with and play games of chance and/or skill on respective mobile devices 544. A mobile device 544 may correspond to a player's 116 personal device (e.g., a smartphone) or to a device issued to the player 116 during the player's visit at a particular casino. It should be appreciated that the player 116 may play games directly on their mobile device 544 and/or the mobile device 544 may be in communication with an electronic gaming system 508 such that the mobile device 544 provides the human-to-machine interface for the player 116 to the gaming system 508. The mobile device 544 may be in communication with the communication network 504, directly or via a network access point 510, or in direct communication (e.g., via Bluetooth, WiFi, etc.) with a gaming system 508. Non-limiting examples of a mobile device 544 include a cellular phone, a smart phone, a tablet, a wearable device, an augmented reality headset, a virtual reality headset, a laptop, a Personal Computer (PC), or the like.

The game management server 516 is further shown to include a processor 216, memory 220, and a network interface 224. These resources may enable functionality of the game management server 516 as will be described herein. For instance, the network interface 224 provides the server 516 with the ability to send and receive communication packets or the like over the communication network 504. The network interface 224 may be provided as a network interface card (NIC), a network port, drivers for the same, and the like. Communications between the components of the server 516 and other devices connected to the communication network 504 may all flow through the network interface 224.

Illustrative instruction sets that may be stored in memory 220 include, without limitation, a game instruction set 532, a wager instruction set 536, a side bet wager instruction set 540, and a payout table instruction set 556. Functions of the server 516 enabled by these various instruction sets will be described in further detail herein. It should be appreciated that the instruction sets depicted in FIG. 5 may be combined (partially or completely) with other instruction sets or may be further separated into additional and different instruction sets, depending upon configuration preferences for the server 516. Said another way, the particular instruction sets depicted in FIG. 5 should not be construed as limiting embodiments described herein.

In some embodiments, the game initiation set 532, when executed by the processor 216, may enable the game management server 516 to generate a gaming session for one or more players 116 or enable one or more players 116 to access remotely, participate in, or otherwise play a gaming session on another electronic gaming system 508. The gaming session can be an automated (e.g., using pseudo-random or random number generated symbols, characters, or outcomes) or a live gaming session, such as a card or non-card gaming session. In some embodiments, the game instruction set 532, when executed by the processor 216, may enable the game management server 516 to facilitate one or more games of chance or skill and produce interactions between a player 116 or group of players and the game of chance or skill. In some embodiments, the game instruction set 532 may include subroutines that present one or more graphics to the player 116 or group of players, subroutines that calculate whether a particular wager has resulted in a win or loss during the game of chance or skill, subroutines for determining payouts for each player 116 in the event of a win, subroutines for exchanging communications with a connected electronic gaming system 508, subroutines for enabling the player 116 or group of players to engage in a game using their mobile device 544, and any other subroutine or set of instructions that facilitate gameplay at or in association with the electronic gaming system 508.

In some embodiments, the wager instruction set 536, when executed by the processor 216, may enable the game management server 516 to receive and process wagers by players and adjust player accounts to reflect gaming session outcomes (e.g., to increment an electronic record in a player's account to reflect awards realized from a wager on a winning result or decrement a player's account to reflect losses from a wager on a losing result of the gaming session). For example, the wager instruction set can cause the processor 216 to compare the first outcome of the first gaming device 106 with a subset of the first and second sets of potential outcomes of the game, the subset being associated with a wager of a player, to determine a first result of the game.

The side bet wager instruction set 540, when executed by the processor 216, may enable the game management server 516 to and process side bets by players and adjust player accounts to reflect gaming session outcomes (e.g., to increment an electronic record in a player's account to reflect awards realized from a side bet on a winning result or decrement a player's account to reflect losses from a wager on a losing result of the gaming session). For example, the side wager instruction set 540, when executed by the processor 216, can cause the processor 216 to translate a first potential outcome (e.g., a lucky number from 0 to 9) selected by a player into a subset of the set of potential outcomes (e.g., the numbers including the selected lucky number), the subset comprising the first potential outcome and a second potential outcome that is different from the first potential outcome, and compare the second outcome of the second gaming device 112 with a subset of the first and second sets of potential outcomes of the game, the subset being associated with a wager of a player, to determine a second result of the game.

One of the wager instruction set 536 and side bet wager instruction set 540, when executed by the processor 216, can cause the processor 216 to compare the first and second outcomes with the subset to determine a joint result of the game.

The payout table instruction set 556, when executed by the processor 216, may enable the game management server 516 to select a payout table, from among multiple payout tables, to apply to the first, second, and joint results to determine the winnings of each player and adjust appropriately a value of an electronic record associated with an account of each player to reflect the first, second, and joint results of the game.

Figure 6:
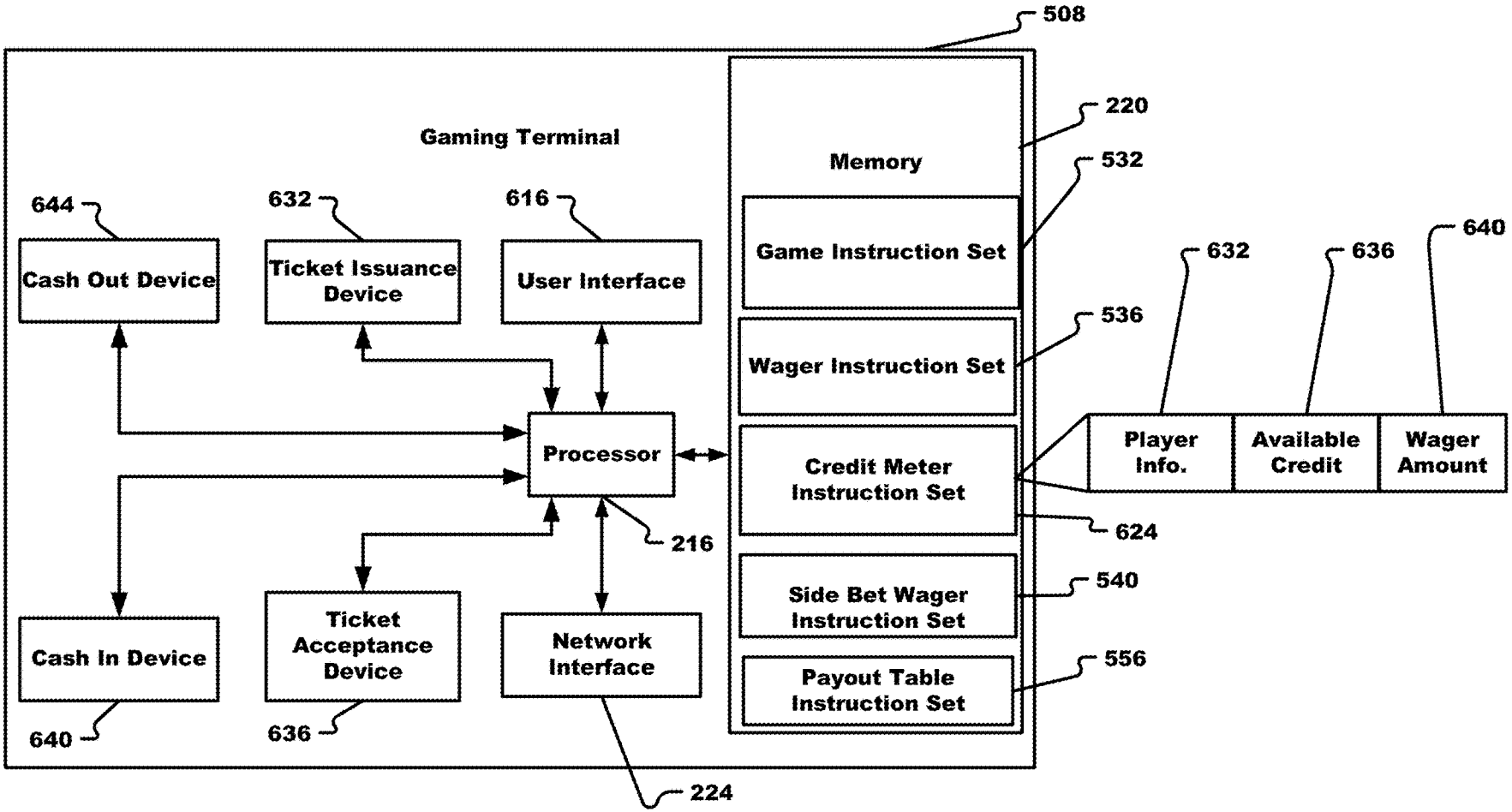
FIG. 6 is a block diagram depicting details of an electronic gaming terminal and a player gaming station in accordance with embodiments of the present disclosure.

With reference now to FIG. 6, additional details of a gaming system 508 will be described in accordance with at least some embodiments of the present disclosure. The electronic gaming system 508, for example, can be a player gaming station 212 in FIG. 2 or the electronic gaming terminal 304 of FIG. 3. While depicted as an electronic gaming system 508, it should be appreciated that some or all of the components of the gaming system 508 may be included in a player's 116 mobile device 544 without departing from the scope of the present disclosure.

The electronic gaming system 508 is depicted to include a processor 216, memory 220, a network interface 224, and a user interface 616.

The user interface 616 may correspond to any type of input and/or output device that enables the player 116 to interact with the electronic gaming system 508. As can be appreciated, the nature of the user interface 616 may depend upon the nature of the gaming system 508. For instance, if the gaming system 508 is a traditional mechanical reel slot machine, then the user interface 616 may include one or more mechanical reels with symbols provided thereon, one or more lights or LED displays, one or more depressible buttons, a lever or "one armed bandit handle", a speaker, or combinations thereof. If the gaming system 508 is a digital device, then the user interface 616 may include one or more touch-sensitive displays, LED/LCD display screens, etc. Examples of this type of gaming system and associated displays include the ETG system 200 or 300 and associated table main table display 210, and the electronic display 250 of the player station gaming system 212 or electronic gaming terminal 304.

The memory 220 may be configured to store instruction sets that enable player interaction with the gaming system 508, that enable game play at the gaming system 508, and/or that enable coordination with the game management server 516. Examples of instruction sets that may be stored in the memory 508 include the game instruction set 532, wager instruction set 536, credit meter instruction set 624, side bet wager instruction set 540, and payout table instruction set 556.

The credit meter instruction set 624 may correspond to a secure instruction set within the gaming system 508 that creates one or more credit meters to track activity at the gaming system 508, such as an amount of money or number of credits a player can use on the gaming system 508. The types of information that may be maintained by the credit meter instruction set 624 in each credit meter includes, without limitation, player information 632, available credit information 636, wager amount information 640, and other types of information that may or may not need to be recorded for purposes of accounting for wagers placed at the gaming system 508 and payouts made for a player 116 during a game of chance or skill played at the gaming system 508. In some embodiments, the credit meter instruction set 624 may be configured to track coin in activity, coin out activity, coin drop activity, jackpot paid activity, mini bonus paid activity, credits applied activity, external bonus payout activity, voucher in activity, voucher out activity, timing of events that occur at the gaming system 508, and the like. In some embodiments, the credit meter instruction set 624 may update a credit meter in response to outcomes of a game of chance or skill played at the gaming system 508 or the gaming system 508 of another player member, such as a side bet on a gaming session played by one or more different players on a different gaming system 508.

In some embodiments, a respective credit meter may be instantiated for each of the side bets in a player-selected subset of side bets. Each of the credit meters for a given player-selected subset of side bets can include common player information 632, respective available credit 636, and respective (side bet) wager amount 640. As will be appreciated, the available credit 636 and side bet wager amount 640 for each of the credit meters for a selected player can be the same or different, depending on the gaming session and player activities.

The player information field 632 may be used to store any type of information that identifies a player. In some embodiments, the player information field 632 may store one or more of username information for a player 116, contact information for the player (such as email address, phone number, social website webpage universal resource locator, and the like), password information for a player account, player status information, accommodations associated with the player 116, and any other type of customer service management data that may be stored with respect to a player 116.

The available credit field 636 may be used to store data about a player's 116 available credit with a casino or a plurality of casinos. For instance, the available credit field 636 may store an electronic record of available credit in the player's account and whether any restrictions are associated with such credit. The available credit field 636 may further store information describing a player's available credit over time, wagers made over time, cash out events for the player, winning events for the player, and the like.

The wager amount field 640 may be used to store information describing wagers and side bets placed by the player 116 in a current game.

Figure 7:
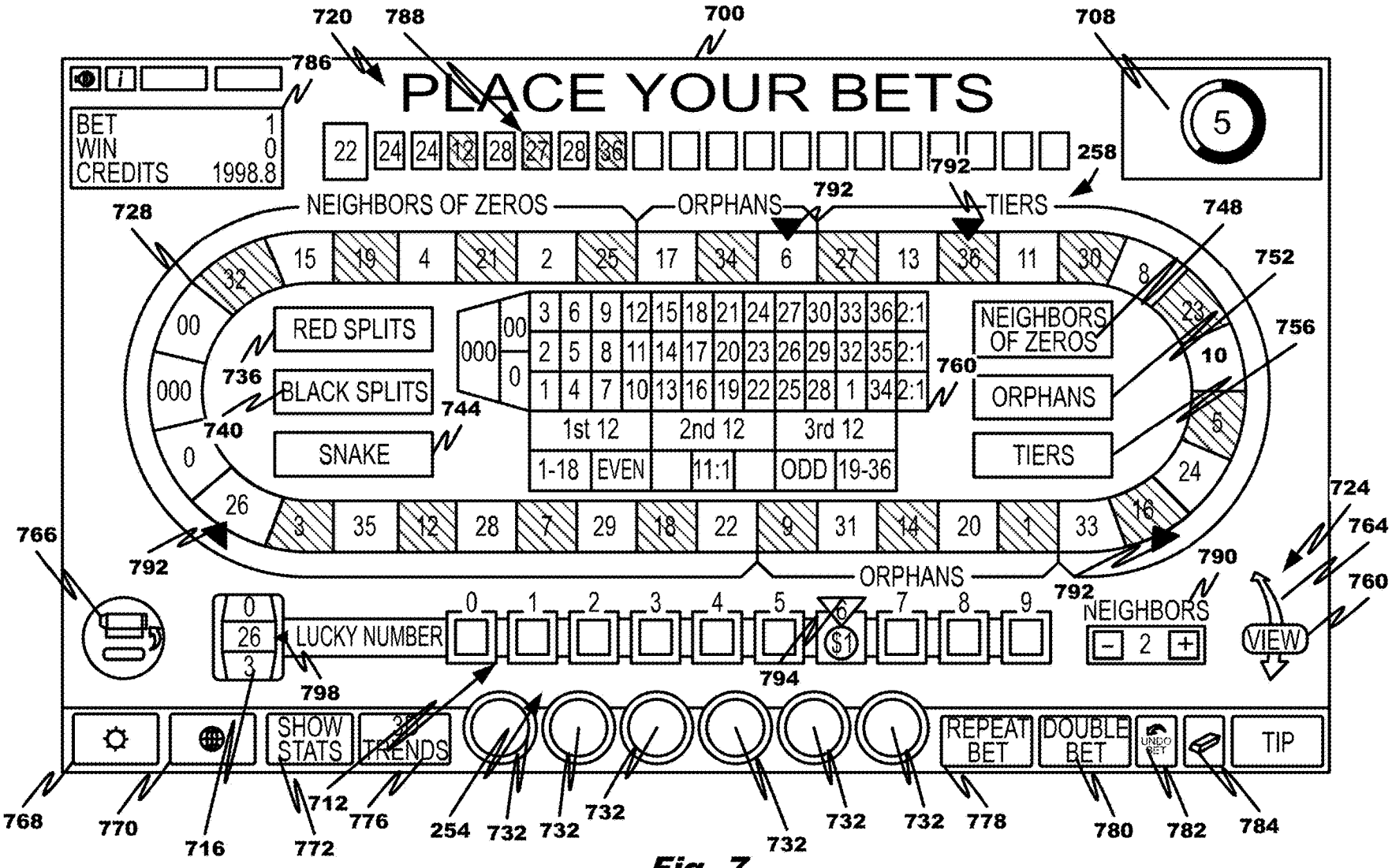
FIG. 7 is a user interface display in accordance with embodiments of the present disclosure.

With reference now to FIG. 7, an example of a display 700 for roulette is presented in accordance with an embodiment. The display 700 comprises a player wagering zone or gaming chip placement zone 258, a side bet wagering zone or gaming placement zone 254, a wager cut off timer 708, a lucky number field 712, a first outcome display 716, a game messaging field 720, and a change table viewing angle control 724.

The player wagering zone or gaming chip placement zone 258 can include a number of potential outcomes in a first set of potential outcomes for placing wagers, such as by virtual chips 732. For example, the first set of potential outcomes can include potential outcomes in the race track 728 (e.g., the integer numbers "0", "00", "000", and from 1 to 36. As will be appreciated, each of the integers corresponds to a color from the set of red, black and green (with the integers"0", "00", and "000" being green, the integers 2, 4, 6, 8, 10, 12, 14, 16, 18, 20, 22, 24, 26, 28, 29, 31, 33, and 35 being black, and the integers 1, 3, 5, 7, 9, 11, 13, 15, 17, 19, 21, 23, 25, 27, 30, 32, 34, and 36 being red). Additional potential outcomes in the first set of potential outcomes include a number of bets known to one of ordinary skill in the gaming art, including RED SPLITS 736, BLACK SPLITS 740, SNAKE 744, NEIGHBORS OF ZEROS 748, ORPHANS 752, TIERS 756, and the outcomes in the inner field 760 of the race track 728 (e.g., 1-18, EVEN, 11:1, ODD, 19-36, $1^{ST}$ 12, $2^{ND}$ 12, and $3^{RD}$ 12. The player wagering zone 258, in one embodiment, may include a gaming chip detection component (not shown) which may be adapted to detect automatically the presence and/or monetary amount of gaming chips which have been placed within a player's wagering zone, and the player wagering zone 258 may, in one embodiment, include icons or other symbols representing the presence and/or monetary amount of gaming chips placed on a separate physical surface, such as on a gaming table surface. The player wagering zone 258 may, in one embodiment, receive icons or other symbols representing the presence and/or monetary amount of gaming chips dragged and dropped by the player on the appropriate wager locations.

In one embodiment, the side bet wagering zone 254 can include a number of potential outcomes in a second set of potential outcomes for placing side bets, such as by virtual chips 732. For example, the second set of potential outcomes can include the same potential outcomes as in the race track 728 (e.g., the integer numbers "0", "00", "000", and from 1 to 36 and the corresponding color for each of the integers (with the integers"0", "00", and "000" being green, the integers 2, 4, 6, 8, 10, 12, 14, 16, 18, 20, 22, 24, 26, 28, 29, 31, 33, and 35 being black, and the integers 1, 3, 5, 7, 9, 11, 13, 15, 17, 19, 21, 23, 25, 27, 30, 32, 34, and 36 being red). Like the player wagering zone 258, the side bet wagering zone 240, in various embodiments, can include a gaming chip detection component (not shown) which may be adapted to automatically detect the presence and/or monetary amount of gaming chips which have been placed within a player's wagering zone; icons or other symbols representing the presence and/or monetary amount of gaming chips placed on a separate physical surface, such as on a gaming table surface; or receive icons or other symbols representing the presence and/or monetary amount of gaming chips v dragged and dropped by the player on the appropriate wager locations.

In one embodiment, the wager cut off timer 708 is a countdown or count-up timer depicting a time remaining for players to place wagers in one or both of the player wagering zone 258 and side bet wagering zone 254.

In one embodiment, the change table viewing angle control 724 adjusts the view of the board, so the player can select different viewing angles of the player (relative to a selected viewing position of the player) to place bets in the wager and side bet zones 258 and 254. The change table viewing angle 724 can enable a player to view the objects depicted in the display at many angles including flat like a painting hanging on the wall or inclined at a desired angle relative to the viewing position of the player. The player, by manipulating a control icon 760 back-and-forth along an arc 764 (which indicates a viewing angle relative to a flat surface) can select a viewing angle of the displayed virtual playing surface relative to the viewing position of the player. This ability, for example, can enable the player to visualize more easily details of the gaming session compared to a fixed viewing angle alone (for example, an object such as a stack of chips can be viewed in side (or in two dimensions) or perspective view (or in three dimensions) depending on the position of the control icon 760 relative to the arc 764). In one embodiment, this result is realized by the change table viewing angle control 760 adjusting a camera angle in a forward, backward, left, and/or right direction as the control 760 is moved upwardly and downwardly along the arc 764.

The display 700 can include a number of other controls including a change view icon 766 (which if selected will change the view from the racetrack-centric view with side betting options to a main betting display without side betting options), a settings icon 768 (which if selected will change the settings of the associated electronic gaming terminal 304), the globe icon 770 (which if selected will change the language for displayed text), the show statistics icon 772 (which if selected displays how often a selected potential outcome in the first set of potential outcomes has been the outcome of a game), the 3D trends icon 776 (which if selected presents the trends of various games as a three-dimensional bar graph), the repeat bet icon 778 (which if selected repeats a last bet of the player), a double bet icon 780 (which if selected repeats and doubles a last bet of the player), an undo bet icon 782 (which if selected undoes a previously placed bet), an eraser icon 784 (which if selected enables the player to remove a bet by touching the potential outcome where the bet is placed), and a neighbors icon 790 (which includes a negative and positive control to decrement and increment the display integer in connection with the neighbors potential outcome relative to a selected integer on the race track 72.

The display can also provide gaming information. For example, the player information field 786 presents gaming information associated with the corresponding player, the game messaging field 720 displays various messages associated with a current status of the game being played (e.g., in the order of appearance: "PLACE YOUR BETS", "NO MORE BETS", and "BALL LANDS ON [potential outcome occurring as the second outcome]"), and the second outcome history field 788, which displays the first outcomes of prior games.

An example of the side bet features of the present disclosure will be discussed with reference to the display 700. In this example, the player 116 places a bet on one of the "Lucky Number" side betting spots (i.e., any of the integers from "0" through "9") 712 in the side wagering field 254 (with the example showing a player 116 side bet on the "6" integer), each of which corresponds to a potential outcome in the first and second sets of potential outcomes. As illustrated, placing a side bet on one of the "Lucky Number" betting spots 712 causes all integer numbers with the same last integer, which form a corresponding subset of the first and second potential outcomes (as shown in the display 700 the player 116 has placed a side bet in the "Lucky Number" side betting spots on the integer "6", which corresponds to a subset of potential outcomes comprising the integers 6, 16, 26, and 36), to be illuminated by a plurality of markers 792 (for 6, 16, 26, and 36 in the race track 728) and 794 (for 6 in the Lucky Number side betting spots 712), with each of the potential outcomes in the corresponding subset in the race track 728 having a respective marker 792 (in the example the markers 792 illuminate each of the numbers "6", "16", "26" and "36"). The Random Number Generator (RNG) 230 will randomly pick an integer number in the range 0-36, inclusive, after no more bets is called (or the wager cutoff timer 708 expires). The "NO MORE BETS" message is displayed in the message field 720 after the wager cutoff timer 708 counts down to zero. If the RNG 230 randomly picked number, or first outcome, ends in a potential integer outcome in the subset of potential outcomes corresponding to the selected integer in the Lucky Number betting spots 712 (in the example the corresponding subset of the selected potential outcome "6" comprises the integers "6", "16", "26" and "36" and the RNG outcome as shown by marker 798 is "26"), then the first outcome will correspond to a winning result, and the respective first multiplier (example payouts are shown in the payout table of FIG. 8) will be applied to the side bet and the appropriate winnings paid to the player.

Immediately after the wager cutoff timer 708 has reached zero and no more bets has been called in the message field 720, then the roulette ball is dropped into the roulette wheel 224 as discussed above. Thus, the RNG 230 will select the first outcome and the first outcome will be displayed in the first outcome display 716 as the ball is travelling around the roulette wheel 224 and before the ball has landed on an integer in the race track 728 (or produced the second outcome). If the physical ball in the roulette wheel then lands on a number that also ends in the corresponding subset of potential outcomes, the second and joint outcomes will each correspond to a wining result and the non-matching or matching joint multiplier as appropriate (example payouts are shown in the payout table of FIG. 8) will be applied to the side bet and the appropriate winnings paid to the player.

If the RNG 230 does not produce a number ending in the corresponding subset of potential outcomes for the player, but the ball physically lands on an integer number ending in the corresponding subset (in the example the lucky numbers are "6", "16", "26" and "36"), the second outcome corresponds to a winning result and respective second multiplier (example payouts are shown in the payout table of FIG. 8) will be applied to the side bet and the appropriate winnings paid to the player.

If the first and second outcomes are an exact match and are in the corresponding subset chosen by the player, the joint outcome corresponds to a winning result and respective matching joint multiplier (example payouts are shown in the payout table of FIG. 8) will be applied to the side bet and the appropriate winnings paid to the player.

This can enable the player to win one of four different ways: based on the first outcome, the second outcome, the non-matching joint outcome, or the matching joint outcome. The player even has the opportunity for a large payout when the first and second outcomes match each other and a potential outcome in the corresponding subset of potential outcomes.

With reference to FIG. 8, an exemplary payout table 800 is depicted. The payout table 800 includes a number column 804, which corresponds to an integer in the Lucky Number betting spots 712, the outcome column 808 shows the number of potential outcomes corresponding to the associated integer (e.g., for "0" the number of potential outcomes in the corresponding subset is 5 (or 0, 00, 10, 20, and 30), the probability column 812 shows the probability of either the wheel 224 or RNG 230 producing a potential outcome in the subset, the pays (1 to x) column 816 shows the multiplier applied to the side bet of the player for a winning result as the first outcome (shown as the RNG outcome), the expected value column 820 shows the expected value corresponding to the associated integer (the expected value is typically the weighted average of the possible values of a random variable, with weights given by their respective theoretical probabilities) for a winning result as the first outcome, the pays (1 to x) column 824 shows the multiplier applied to the side bet of the player for a winning result as the second outcome (shown as the Wheel outcome), the expected value column 828 shows the expected value corresponding to the associated integer for a winning result as the second outcome, the pays (1 to x) column 840 shows the multiplier applied to the side bet of the player for a winning (joint) result as the first and second outcomes (with the winning results of each of the first and second outcomes not matching), the expected value column 844 shows the expected value corresponding to the associated integer for a winning (non-matching joint) result as the first and second outcomes, the pays (1 to x) column 848 shows the multiplier applied to the side bet of the player for a winning (joint) result as the first and second outcomes (with the winning results of each of the first and second outcomes matching), the expected value column 852 shows the expected value corresponding to the associated integer for a winning (matching joint) result as the first and second outcomes, the return to player percentage (RTP) column 856 shows how much money bet on a side bet will be returned to a player, and the house edge column 860 shows how much money bet on a side bet will be returned to the house (the sum of the RTP and house edge for any side bet is 1 or 100%). As will be appreciated, RTP and house edge are calculated over time, and the total of each column is the average RTP or house edge, respectively, over time.

The top of the payout table 800 lists the casino-selectable or configurable parameters associated with the payout table 800. The first variable 832 is "Double 0" and describes the type of wheel as the first and second gaming devices. The values selectable for the first variable 832 include "0" (which corresponds to a wheel and RNG having no "00" or "000" or "0000" fields and therefore would require the number of outcomes column 808 for 0 to be reduced to 4 (or 0, 10, 20, and 30) and the other values in the probability column 812, pays (1 to x) and expected value columns 816 and 820 for the second outcome, and in the pays (1 to x) and expected value columns 824 and 828 for the first outcome, pays (1 to x) and expected value columns 824 and 828 for the second outcome, pays (1 to x) and expected value columns 840 and 844 for the non-matching joint outcome, and pays (1 to x) and expected value columns 848 and 852 for the matching joint outcome to be adjusted accordingly); "00" as shown (which corresponds to a wheel and RNG having "0" and "00" fields but no "000" field); "000" (which corresponds to a wheel and RNG having "0", "00" and "000" fields and therefore would require the number of outcomes column 808 for 0 to be increased to 6 (or 0, 00, 000, 10, 20, and 30) and the other values in the probability column 812, pays (1 to x) and expected value columns 816 and 820 for the first outcome, and in the pays (1 to x) and expected value columns 824 and 828 for the second outcome, pays (1 to x) and expected value columns 840 and 844 for the non-matching joint outcome, and pays (1 to x) and expected value columns 848 and 852 for the matching joint outcome to be adjusted accordingly); and "0000" (which corresponds to a wheel and RNG having "0", "00", "000", and "0000" fields and therefore would require the number of outcomes column 808 for 0 to be increased to 7 (or 0, 00, 000, 0000, 10, 20, and 30) and the other values in the probability column 812, pays (1 to x) and expected value columns 816 and 820 for the first outcome, pays (1 to x) and expected value columns 824 and 828 for the second outcome, pays (1 to x) and expected value columns 840 and 844 for the non-matching joint outcome, and pays (1 to x) and expected value columns 848 and 852 for the matching joint outcome to be adjusted accordingly). The second variable 836 is the house edge, which is shown as 5.26%. In numbers, it is the casino's average profit from a player's bet. For roulette, a house edge of 5.26% means for every dollar bet, the casino keeps 5.260 as profit, and returns the other 94.74¢ to the players as winnings, on average. The payout table of FIG. 8 is used for illustration purposes only.

One of ordinary skill in the gaming art will appreciate that other types of payout tables can be employed depending on the application.

As can be seen from FIG. 8, the first and second multiplier for the first and second outcomes as winning results, by virtue of the first and second sets of potential outcomes using the same set of integers as potential outcomes can be identical. The joint multiplier for the joint outcome as a winning result is typically greater than the first and second multipliers, with the exact match multiplier used for an exact match winning result for the joint outcome is typically greater than the first, second, and other types of joint multipliers.

The operation of the payout table 800 is demonstrated by an exemplary side bet of $5.00 on the Lucky Number "6" as shown, respectively, by references 866 and 870. When only one of the first or second outcomes is a winning result, the player wins $15.00 ($5×3). When both of the first and second outcomes are a non-matching winning joint result, the player wins $40.00 ($5×8). Finally, when both of the first and second outcomes are a matching winning joint result, the player wins $500 ($5×100).

The payout table instruction set 556 in the game management server 516 or electronic gaming system 508 can include a plurality of payout tables, each corresponding to a unique set of roulette wheel type (e.g., single "0", double "0", triple "0", quadruple "0", etc.) and house edge. The casino operator can select for the networked gaming system 500 as a whole or gaming system-by-gaming system a set of roulette wheel type and house edge.

While the embodiments and examples of FIGS. 2A, 2B, 3, 4, 5, 6, 7 and 8 have been discussed with reference to roulette as the second gaming device 112 and an RNG 230 as the first gaming device 106, it is to be appreciated that the teachings of the present disclosure can be applied to other types of gaming devices, such as a card or slot game using symbols rather than integers, a dice game, or another type of wheel game.

Figure 9:
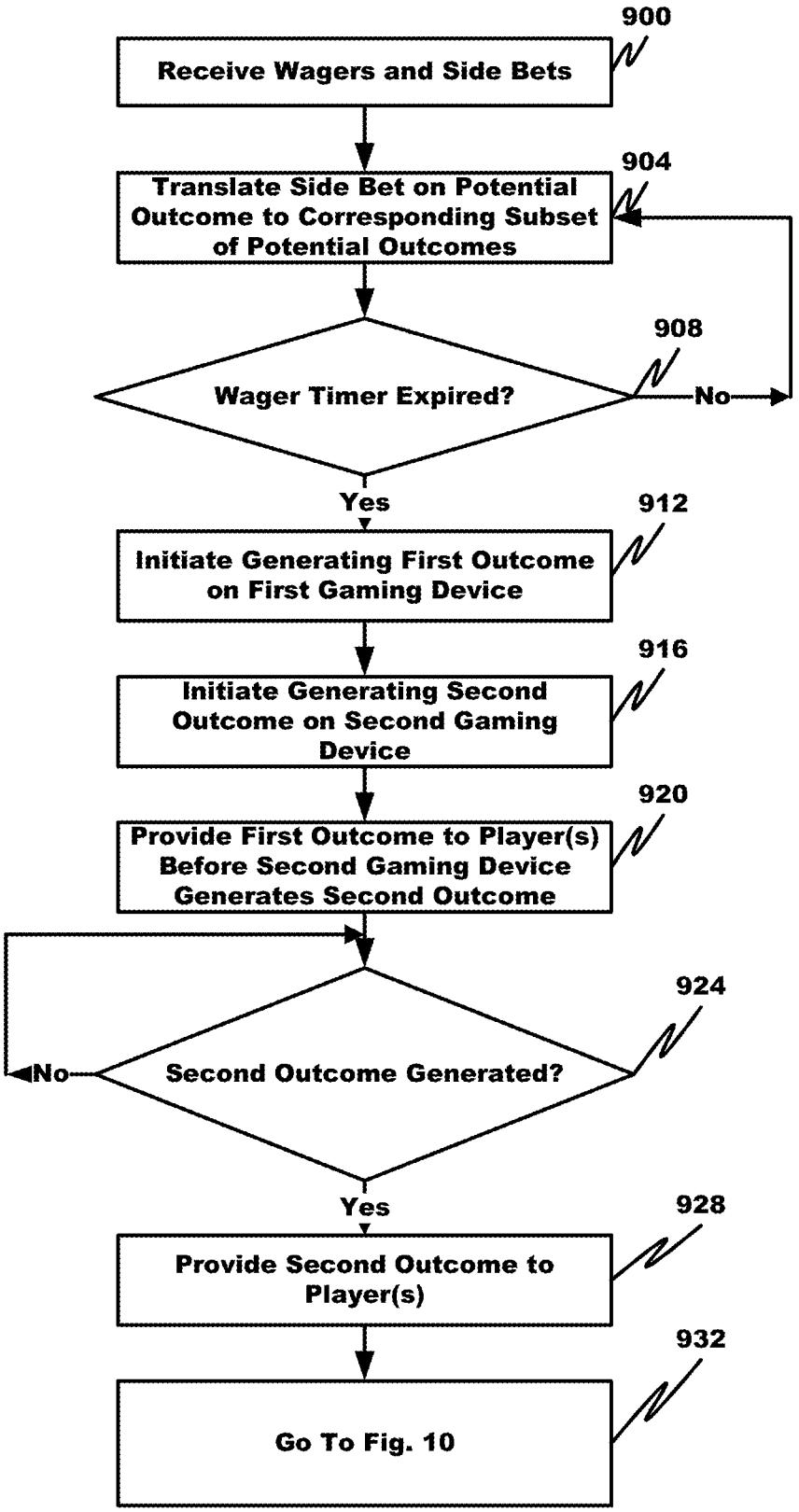
FIG. 9 is a flow diagram depicting a game play method in accordance with embodiments of the present disclosure.

With reference to FIG. 9, a method of configuring a side bet wagering zone 704 will be described in accordance with embodiments of the present disclosure.

The method begins in step 900 by the electronic gaming system 508 and/or game managing server 516 receiving wagers and side bets from players and adjusting an electronic record, such as the wager amount field 640. The electronic gaming system 508 displays the message "PLACE YOUR BETS" in the message field 720.

The method continues in step 904 by the electronic gaming system 508 and/or game managing server 516 translating any side bets of the players 116 placed on a potential outcome in a side wagering subset (the Lucky Number betting spots 712) into the corresponding subset of the first and second potential outcomes of the first and second gaming devices 106 and 112 in the electronic gaming system 508. For example with reference to FIG. 7, the player 116, as indicated by marker 794, has placed a side bet on the "6" in the Lucky Number betting spots 712. The electronic gaming system 508 translates automatically the "6" into the other integers in the race track 728 ending in a "6", namely "6", "16", "26" and "36" and illuminates the other integers by displaying the markers 792.

In decision diamond 908, the electronic gaming system 508 and/or game managing server 516 determines whether or not the wager cutoff timer 708 has expired. If not, the electronic gaming system 508 returns to step 904. If so, the electronic gaming system 508 proceeds to step 912.

In step 912, the method continues by the electronic gaming system 508 and/or game managing server 516 displaying the message "NO MORE BETS" in the message field 720 and initiating a game, typically with multiple players. The game is generally initiated by the second gaming device 112 starting to generate the second outcome, such as by the roulette wheel starting to rotate and/or the roulette ball dropping in the ball track.

The method continues, in step 916, by the electronic gaming system 508 and/or game managing server 516 initiating generation of the first outcome on the first gaming device 106.

The method continues, in step 920, by the electronic gaming system 508 and/or game managing server 516 providing the first outcome to the player before the second gaming device 112 generates the first outcome. This can increase player 116 excitement. The electronic gaming system 508 displays the first outcome in the first outcome display 716.

The method continues in step 924 by the electronic gaming system 508 and/or game managing server 516 determining whether or not the second outcome has been generated (e.g., the roulette ball has landed on an integer in the race track 728). If not, the electronic gaming system 508 repeats the decision diamond query 924 and, if so, the electronic gaming system 508 proceeds to step 928.

In step 928, the method continues by the electronic gaming system 508 providing the second outcome to the player(s) 116, such as by displaying the message "THE BALL HAS LANDED ON XX" in the message field 720, with XX being the integer upon which the ball has landed.

Figure 10:
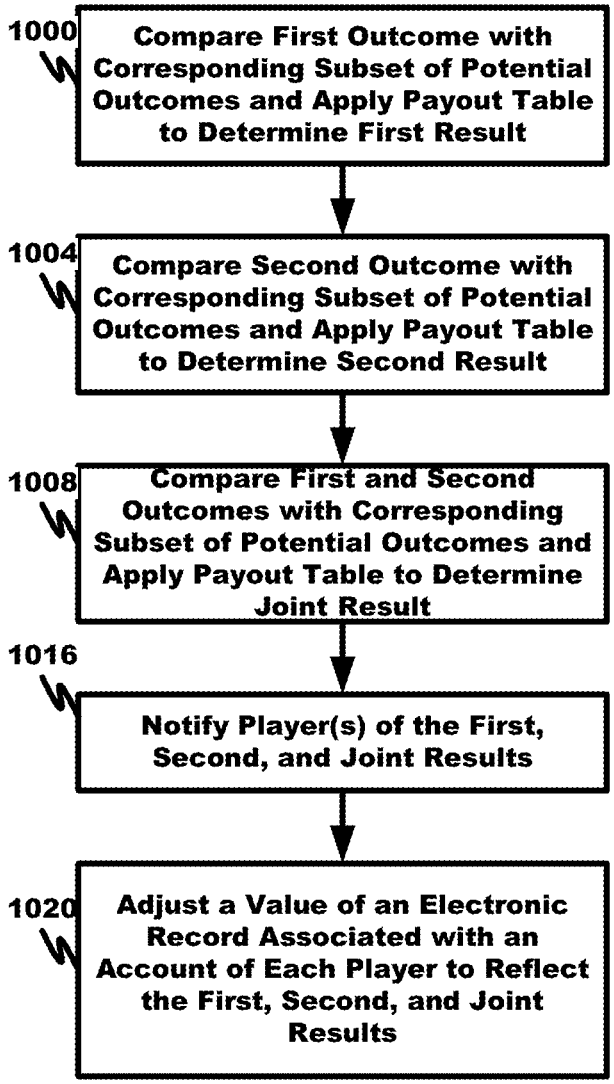
FIG. 10 is a flow diagram depicting a game play method in accordance with embodiments of the present disclosure.

The method continues in step 932 by the electronic gaming system 508 determining the winnings of the players as set forth in FIG. 10.

Referring to FIG. 10, the electronic gaming system 508 and/or game managing server 516, in step 1000, retrieves the appropriate payout table 800 and compares the first outcome with the corresponding subset of potential outcomes and applies the payout table to determine the first result. For example with reference to FIG. 7, the electronic gaming system 508 determines whether the ball has landed on any of "6", "16", "26" or "36". If it has, the first outcome is a winning result, and, if it has not, the first outcome is a losing result.

The method continues in step 1004 by the electronic gaming system 508 and/or game managing server 516 comparing the second outcome with the corresponding subset of potential outcomes and applying the payout table to determine the second result. For example with reference to FIG. 7, the electronic gaming system 508 determines whether the second outcome matches any of "6", "16", "26" or "36". In the example, the "26" in the second outcome display 716 matches the number "26" illuminated by marker 792 on the race track 728 and therefore the second outcome is a winning result. If the second outcome were not to match the subset, the second outcome would be a losing result.

The method continues in step 1008 by the electronic gaming system 508 and/or game managing server 516 comparing the first and second outcomes to the corresponding subset of potential outcomes and applying the payout table to determine the joint result. In the example of FIG. 7, the gaming system 508 compares the first and second outcomes to the subset of numbers "6", "16", "26" and "36" to determine whether the joint outcome is a winning or losing result. As noted, if the first and second outcomes were not to match one another but each matched a number in the subset of "6", "16", "26" and "36", the joint outcome would be a joint non-matching winning result and if the first and second outcomes were to match one another and a number in the subset of "6", "16", "26" and "36", the joint outcome would be a joint matching winning result.

In step 1016, the electronic gaming system 508 and/or game managing server 516 notifies the players of the first, second, and joint results, such as by a suitable message displayed in the message field 720.

Finally, the electronic gaming system 508 and/or game managing server 516, in step 1020, adjusts a value of an electronic record associated with a player account of each player to reflect the respective outcome. The electronic account can be for example the available credit field 636.

As should be appreciated by one skilled in the art, aspects of the present disclosure have been illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store, a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C #, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure have been described herein with reference to flowchart illustrations and/or block diagrams of methods, apparatuses (systems) and computer program products according to embodiments of the disclosure. It should be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The invention is claimed as follows:

1. A method for operating a gaming system, comprising:

receiving, by a processor from a player station gaming system of a plurality of player station gaming systems via an interface and during a timed segment of a game, information about a wager of a player on a potential outcome of the game;

receiving, by the processor, a timing signal from a timer indicating an ending of the timed segment;

in response to receipt of the timing signal, causing, by the processor, a first random number generator, using a first seed value as input, to generate a first random number to produce a first outcome for the game;

in response to receipt of the timing signal, causing, by the processor, a ring of a second gaming device to rotate in a first direction relative to a roulette ball and/or indicator to generate a second outcome for the game, the first and second outcomes being independent of one another, wherein the first outcome is a potential outcome in a first set of potential outcomes of the first random number generator, the second outcome is a potential outcome in a second set of potential outcomes of the second gaming device, and wherein the first and second sets of potential outcomes are different;

before the second gaming device generates the second outcome, causing, by the processor, a display to render the first outcome to the player;

comparing, by the processor, the first outcome with a subset of the first and second sets of potential outcomes of the game, the subset being associated with the wager of the player, to determine a first result of the game;

comparing, by the processor, the second outcome with the subset to determine a second result of the game;

determining, by the processor, based on the first and second outcomes a joint result of the game; and notifying, by the processor, the player of an applicable one or more of the first, second, and joint results of the game.

2. The method of claim 1, wherein the interface comprises a switch hub of an electronic table game, wherein the subset is common to the first and second sets of potential outcomes for the first and second gaming devices, respectively, wherein the subset comprises a first potential outcome, wherein the first potential outcome is a subject of the player's wager, and further comprising:

translating, by the processor, the first potential outcome into the subset, the subset comprising the first potential outcome and a second potential outcome that is different from the first potential outcome, and wherein each potential outcome in the subset is a potential outcome for each of the first and second gaming devices.

3. The method of claim 1, wherein the interface comprises a network interface, wherein the roulette ball and/or indicator comprises a roulette ball, wherein the first random number generator and second gaming device have differing probabilities of generating a winning result, wherein the second gaming device comprises an automatic roulette wheel and the game comprises a roulette game, wherein the first gaming device comprises a random number generator, wherein the first potential outcome comprises an integer, wherein each potential outcome in the subset comprises the integer, and further comprising:

causing, by the processor, a motor to rotate a roulette wheel;

causing, by the processor, the roulette ball to drop in the rotating roulette wheel;

sensing, by a sensor, that the roulette ball has come to rest in in a pocket of the roulette wheel;

determining, by the processor based on sensor input, the second outcome; and adjusting, by a processor, a value of an electronic record associated with an account of the player to reflect the applicable one or more of the first, second, and joint results of the game.

4. The method of claim 1, wherein the second gaming device comprises a second random number generator, wherein the plurality of player station gaming systems comprise a plurality of networked electronic gaming terminals, and further comprising:

in response to receipt of the timing signal, causing, by the processor, the second random number generator, using a second seed value as input, to generate a second random number corresponding to the second outcome for the game, wherein the processor causes the ring of a second gaming device and the roulette ball and/or indicator to generate the second outcome, wherein the first and second seed values are different and wherein the first seed value comprises a random number previously output by the first random number generator, and the second seed value comprises a random number previously output by the second random number generator; and adjusting, by a processor, a value of an electronic record associated with an account of the player to reflect the applicable one or more of the first, second, and joint results of the game.

5. The method of claim 1, wherein the subset is common to the first and second sets of potential outcomes for the first random number generator and second gaming device, respectively, wherein a first winning result comprises the first outcome matching a potential outcome in the subset, wherein the first winning result comprises a first product of the wager and a first multiplier, wherein a second winning result comprises the second outcome matching a potential outcome in the subset, wherein the second winning result comprises a second product of the wager and a second multiplier, and wherein the first and second multipliers are the same.

6. The method of claim 5, wherein a joint winning result comprises each of the first and second outcomes matching a potential outcome in the subset, wherein the joint winning result comprises a third product of the wager and a third multiplier, and wherein the third multiplier is greater than each of the first and second multipliers.

7. The method of claim 6, wherein a matching winning result of the game comprises each of the first and second outcomes matching each other and a potential outcome in the subset, wherein the matching winning result comprises a fourth product of the wager and a fourth multiplier, and wherein the fourth multiplier is greater than each of the first, second, and third multipliers.

8. A gaming system comprising:

an interface to exchange machine-to-machine communications with a plurality of player station gaming systems;

a first random number generator that receives a first seed value as input and outputs a first random number;

a second random number generator that receives a second seed value as input and outputs a second random number, the first and second seed values being different from each other;

a processor coupled with the interface and first and second random number generators; and a memory coupled with and readable by the processor and storing therein a set of instructions which, when executed by the processor causes the processor to:

receive, from a player station gaming system via the interface and as part of a game, information regarding a wager of a player on a potential game outcome in a set of potential outcomes of the game and on a selected potential outcome in a side wagering subset of the set of potential outcomes of the game;

cause the first random number generator to output the first random number, the first random number producing a first outcome in the game;

cause the second random number generator to output the second random number, the second random number producing a second outcome in the game, wherein the first and second outcomes are independent of one another; and apply the following rules to determine a game outcome:

a first winning result for the game exists when the first outcome matches the selected potential outcome;

a second winning result for the game exists when the second outcome matches the selected potential outcome; and a joint winning result for the game exists when each of the first and second outcomes matches the selected potential outcome.

9. The gaming system of claim 8, wherein the interface comprises a network interface, wherein the first outcome is a potential outcome in a first set of potential outcomes of the first random number generator, the second outcome is a potential outcome in a second set of potential outcomes of the second random number generator, the set of potential outcomes comprising the first and second sets of potential outcomes, and wherein the first and second sets of potential outcomes are different, and wherein translates the selected potential outcome into a corresponding subset of the first and second sets of potential outcomes, wherein the potential outcomes in the corresponding subset are potential outcomes for each of the first and second random number generators.

10. The gaming system of claim 9, wherein the interface comprises a switch hub of an electronic table game, wherein the first seed value comprises a random number previously output by the first random number generator, wherein the second seed value comprises a random number previously output by the second random number generator, wherein the side wagering subset is common to the first and second sets of potential outcomes for the first and second random number generators, respectively, and wherein the processor provides, through a display coupled to the processor, the first outcome to the player before the second random number generator determines the second outcome, wherein the second random number generator is part of a virtual roulette wheel and the game comprises a roulette game, wherein an inner and/or outer ring and/or a virtual indicator of the virtual roulette wheel rotates and stops at a selected winning slot corresponding to the second outcome, wherein the selected potential outcome comprises an integer, wherein each potential outcome in the corresponding subset comprises the integer, and wherein the processor adjusts a value of an electronic record in a credit meter associated with an account of the player to reflect the first, second, and/or joint winning results of the game.

11. The gaming system of claim 9, wherein the plurality of player station gaming systems comprise a plurality of networked electronic gaming terminals, wherein the side wagering subset is common to the first and second sets of potential outcomes for the first and second random number generators, respectively, and wherein the processor provides, through a respective display of each of the plurality of player station gaming systems, the first outcome before the second random number generator determines the second outcome, wherein the second random number generator comprises a wheel and the game comprises a wheel game, wherein the selected potential outcome comprises a symbol, wherein each potential outcome in the corresponding subset comprises the symbol, and wherein the processor adjusts a value of an electronic record associated with an account of the player to reflect the first, second, and/or joint winning results of the game.

12. The gaming system of claim 9, wherein the first winning result comprises a first product of the wager and a first multiplier; wherein the second winning result comprises a second product of the wager and a second multiplier, and wherein the first and second multipliers are the same.

13. The gaming system of claim 12, wherein the joint winning result comprises a third product of the wager and a third multiplier, and wherein the third multiplier is greater than each of the first and second multipliers.

14. The gaming system of claim 13, wherein a matching winning result of the game comprises each of the first and second outcomes matching each other and a potential outcome in the corresponding subset, wherein the matching winning result comprises a fourth product of the wager and a fourth multiplier, and wherein the fourth multiplier is greater than each of the first, second, and third multipliers.

15. A gaming system comprising:

a first gaming device comprising a first random number generator that receives a first seed value as input and outputs a first random number producing a first outcome in a game;

a second gaming device that produces a second outcome in the game, the first and second outcomes being independent of one another, and the second gaming device comprising a roulette wheel;

a timer that generates a first timing signal;

a processor coupled with the first and second gaming devices and timer; and a memory coupled with and readable by the processor and storing therein a set of instructions which, when executed by the processor causes the processor to:

receive, during a timed segment of the game, information regarding a wager from a player on a potential outcome of the game;

receive the first timing signal indicating an ending of the timed segment;

in response to receipt of the first timing signal, cause the first gaming device to generate the first outcome;

in response to receipt of the first timing signal, cause a ring of the roulette wheel to rotate relative to a roulette ball and/or indicator to generate the second outcome for the game, the first and second outcomes being independent of one another;

before the second gaming device generates the second outcome, cause a display to render the first outcome to the player; and compare the first outcome with a common subset of the first and second sets of potential outcomes of the first and second gaming devices, respectively, the common subset being derived from the potential outcome of the game associated with the wager, to determine a first result of the game;

compare the second outcome with the common subset to determine a second result of the game;

compare the first and second outcomes with the common subset to determine a joint result of the game; and notify the player of an applicable one or more of the first, second, and joint results of the game.

16. The gaming system of claim 15, wherein the roulette ball and/or indicator comprises a roulette ball, herein the first and second gaming devices have differing probabilities of generating a winning result for the game, and wherein the processor receives a first potential outcome from the player, translates the first potential outcome into the common subset, wherein each of the potential outcomes in the common subset is a potential outcome for each of the first and second gaming devices; causes a motor to rotate the ring of the roulette wheel in a first direction; causes the roulette ball to drop in the roulette wheel; senses that the roulette ball has come to rest in in a pocket of the roulette wheel; determines, based on sensor input, the second outcome; and adjusts a value of an electronic record associated with an account of the player to reflect the first, second, and joint results of the game.

17. The gaming system of claim 15, wherein the second gaming device comprises a virtual roulette wheel, the virtual roulette wheel comprises a second random number generator, wherein, in response to receipt of the first timing signal, the processor causes the second random number generator, using a second seed value as input, to generate a second random number corresponding to the second outcome for the game, wherein the processor causes the ring of the second gaming device and the roulette ball and/or indicator to generate the second outcome, wherein the first and second seed values are different and wherein a first potential outcome selected by the player comprises an integer, and wherein each potential outcome in the common subset comprises the integer.

18. The gaming system of claim 15, wherein the second gaming device comprises a second random number generator that uses a second seed value as input and outputs a second random number corresponding to the second outcome, wherein the first seed value comprises a random number previously output by the first random number generator, and the second seed value comprises a random number previously output by the second random number generator, wherein a first potential outcome selected by the player comprises a symbol, and wherein each potential outcome in the common subset of the first and second sets of potential outcomes comprises the symbol.

19. The gaming system of claim 16, wherein, when the first outcome matches a potential outcome in the common subset, the first result comprises a first winning result, wherein the first winning result comprises a first product of the wager and a first multiplier, wherein when the second outcome matches a potential outcome in the common subset of the first and second sets of potential outcomes, the second result comprises a second winning result, wherein the second winning result comprises a second product of the wager and a second multiplier, and wherein the first and second multipliers are the same.

20. The gaming system of claim 19, wherein, when each of the first and second outcomes matches a potential outcome in the common subset, the joint result comprises a joint winning result, wherein the joint winning result comprises a third product of the wager and a third multiplier, wherein the third multiplier is greater than each of the first and second multipliers, wherein a matching winning result of the game comprises each of the first and second outcomes matching each other and a potential outcome in the common subset, wherein the matching winning result comprises a fourth product of the wager and a fourth multiplier, and wherein the fourth multiplier is greater than each of the first, second, and third multipliers.

* * * * *